US007779505B2

(12) United States Patent
Krebs et al.

(10) Patent No.: US 7,779,505 B2
(45) Date of Patent: Aug. 24, 2010

(54) WET/DRY VACUUM CLEANER

(75) Inventors: Alan J. Krebs, Pierson, MI (US); Kenneth M. Lenkiewicz, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 424 days.

(21) Appl. No.: 11/684,291

(22) Filed: Mar. 9, 2007

(65) Prior Publication Data

US 2008/0216278 A1 Sep. 11, 2008

(51) Int. Cl.

| | |
|---|---|
| ***A47L 9/00*** | (2006.01) |
| ***A47L 7/00*** | (2006.01) |
| ***A47L 5/00*** | (2006.01) |
| ***A47L 9/10*** | (2006.01) |
| ***A47L 9/20*** | (2006.01) |

(52) U.S. Cl. ..... 15/339; 15/328; 15/320; 15/353

(58) Field of Classification Search ..... 15/339, 15/328, 320, 353

See application file for complete search history.

(56) References Cited

U.S. PATENT DOCUMENTS

| | | | | |
|---|---|---|---|---|
| 3,029,461 | A * | 4/1962 | Osborn | 15/320 |
| 3,896,520 | A | 7/1975 | Williams | |
| 4,017,937 | A * | 4/1977 | Hanold | 15/327.1 |
| 4,251,241 | A | 2/1981 | Bothun | |
| 4,287,636 | A | 9/1981 | Brazier | |
| 4,571,772 | A | 2/1986 | Dyson | |
| 5,287,590 | A | 2/1994 | Yonkers et al. | |
| 5,544,385 | A | 8/1996 | Jailor et al. | |
| 5,735,017 | A * | 4/1998 | Barnes et al. | 15/321 |
| 5,815,881 | A | 10/1998 | Sjogreen | |
| 5,943,732 | A * | 8/1999 | Bosyj et al. | 15/328 |
| 5,958,113 | A * | 9/1999 | Collins et al. | 96/329 |
| 6,712,868 | B2 * | 3/2004 | Murphy et al. | 55/330 |
| 2002/0092122 | A1 | 7/2002 | Zahuranec et al. | |
| 2007/0067945 | A1 * | 3/2007 | Kasper et al. | 15/353 |

FOREIGN PATENT DOCUMENTS

| | | | |
|---|---|---|---|
| EP | 1419723 | A2 | 5/2004 |
| GB | 2365324 | A | 2/2002 |
| GB | 2363705 | | 9/2002 |
| WO | 1995010972 | | 4/1995 |
| WO | 0197671 | | 12/2001 |
| WO | 0217766 | A2 | 3/2002 |

* cited by examiner

*Primary Examiner*—Bryan R Muller
(74) *Attorney, Agent, or Firm*—McGarry Bair PC

(57) ABSTRACT

A wet/dry canister vacuum cleaner has a base assembly, a recovery tank, and a solution tank. A hose interface adapted to mount a vacuum hose is pivotally mounted on the base assembly for selective fluid communication with the inlet to the recovery tank. The hose interface is moveable between a position in which the hose interface is coupled with the recovery tank and a suction source in fluid communication with the recovery tank can draw fluid through the hose interface and the recovery tank, and a second position, in which the hose interface is removed from the recovery tank and the recovery tank can be removed from the vacuum cleaner without having to disconnect the vacuum hose from the vacuum cleaner. The vacuum cleaner can further comprise a diverter assembly for switching between dry and wet mode cleaning, where the diverter assembly forms an inlet to the recovery tank.

18 Claims, 33 Drawing Sheets

WET/DRY VACUUM CLEANER

CROSS-REFERENCE TO RELATED APPLICATION

This application is related to U.S. patent application Ser. No. 11/534,444, filed Sep. 22, 2006, which claims the benefit of U.S. Provisional Patent Application No. 60/596,446, filed on Sep. 23, 2005.

BACKGROUND OF THE INVENTION

1. Field of the Invention

This invention relates to vacuum cleaners. In one of its aspects, the invention relates to a multiple-use vacuum cleaner that is adapted for dry vacuuming, wet vacuuming, and fluid distribution. In another of its aspects, the invention relates to a multiple-use vacuum cleaner in which switching from wet to dry vacuuming is easily accommodated. In still another of its aspects, the invention relates to a wet pick-up vacuum cleaner in which a recovery tank can be removed from a canister without disconnecting a suction hose.

2. Description of the Related Art

Vacuum cleaners are well-known household cleaning devices that are used to clean dirt and debris from rugs and carpets. Vacuum cleaners commonly use a motor-driven suction fan to draw dirt-laden air into the unit, filter the air through some filtering means and exhaust the relatively clean air back into the room. One type of filtering means is a filter bag, wherein dirt-laden air is drawn into a porous bag which traps dirt and allows relatively clean air to exit through the walls of the bag to the environment as disclosed in U.S. Pat. No. 5,544,385 to Jailor et al. However, fine dirt particles can escape through the walls of the bag, thus recontaminating a room. Also, bags must be changed regularly when they are full, which is a time-consuming operation and requires a user to have a supply of new filter bags at hand, which adds additional expense to a vacuum cleaner. Changing filter bags is often a messy operation during which some of the collected dirt can become reentrained in the environment of a room.

An alternative to vacuum cleaners having filter bags as a filtering means are bagless vacuum cleaners which use cyclonic separators to separate dirt from the air using centrifugal force as disclosed in U.S. Pat. No. 4,571,772 to Dyson. Dirt-laden air is introduced into a cyclone separator, usually through a tangential opening near the top of the separator, and flows through the separator in a well-established cyclonic pattern. Dirt is separated from the air and is thrown outwardly against the walls of the separator where it falls down into a collection chamber. Relatively clean air then exits the separator and is exhausted to the environment. As with a bagged vacuum cleaner, this exhausted air may still contain fine dirt particles that were not filtered out in the cyclonic separator. And while the collection chamber for a cyclonic vacuum cleaner can be removed from the vacuum cleaner and emptied with relative ease compared to the changing of a filter bag, the dumping operation can also allow dirt particles to be reentrained in the air.

A third type of filtering means is the use of a water bath to remove dirt from air flowing through a vacuum cleaner as disclosed in U.S. Pat. No. 4,251,241 to Bothun. Dirt-laden air that is drawn in by the suction fan is ported through an air inlet such that it is directed through a reservoir of water. Heavier dirt particles are captured by the water while the filtered air exits the water bath and is exhausted to the environment. The reservoir of water may be a detachable chamber to facilitate disposal of the dirty water after vacuum cleaning. Emptying the reservoir of dirty water is more hygienic in comparison to changing filter bags or emptying a collection chamber filled with dry dirt, since the dirty water can be poured into a sink or drain without any particle re-entrainment into the environment as is observed when pouring out dry dirt.

Even with regular vacuum cleaning, carpets often require more intense cleaning to remove stains or dirt that is deeply ingrained into the carpet pile. One way of deep cleaning a carpet is referred to as wet extraction and can be accomplished distributing a cleaning solution over the carpet and removing the spent cleaning solution by vacuum suction. Many homeowners choose to have this done professionally since they do not have the necessary equipment for deep cleaning a carpet or do not want to purchase a wet extraction machine that will only be used a few times a year. Some vacuum cleaners can be converted into a wet extraction cleaner to combine the functions of dry vacuuming and carpet deep cleaning as disclosed in U.S. Pat. No. 5,287,590 to Yonkers et al. These devices often have many complicated parts that must be interchanged in order to perform each function.

Many homes include bare floors such as linoleum, tile, or hardwood in addition to carpeted surfaces. Most homeowners have vacuum cleaners, whether bagged, bagless, or water-filtered, that are adapted for carpeted surfaces and may damage bare floors, thus additional cleaning devices are required. Bare floors commonly require multiple implements in order to achieve a thoroughly clean surface. Usually, a broom and dustpan are first used to gather and remove loose, dry particles from the floor. However, it is almost impossible to transfer all the dirt onto a dustpan and consequently, some dirt remains on the floor. After sweeping, a cleaning liquid is applied to the floor, most commonly by a sponge or rag mop. A mop is a very efficient cleaning means but when it requires more cleaning solution, the mop must be returned to a bucket to absorb additional cleaning solution to be reapplied to the floor surface. The repeated dipping of the mop into the bucket quickly dirties and cools the cleaning solution rendering the cleaning process less effective. After mopping, some cleaning solution remains on the floor surface to air dry, and the duration of time required for the bare surface to completely dry depends on the amount of residual solution on the floor and the relative humidity in the room. During the drying period, foot traffic must be avoided since dirt and other debris will easily adhere to the damp floor surface.

Some household cleaning devices have been developed that combine carpet dry vacuuming and deep cleaning with bare floor cleaning to eliminate the need for multiple cleaning devices for different types of cleaning. These cleaning devices are referred to as wet/dry vacuum cleaners or three-in-one cleaners. Many of these combined cleaners require disassembling the unit or changing certain parts such as filter or collection means to switch between cleaning types. For example, U.S. Pat. No. 4,287,636 to Brazier discloses a vacuum cleaner that can be used for both dry vacuuming and wet extraction. However, a filter unit for dry vacuuming must be exchanged for a reservoir unit when a user desires to use the vacuum cleaner for extraction.

SUMMARY OF THE INVENTION

According to the invention, a vacuum cleaner comprises a housing, a recovery tank removably mounted on the housing and having an inlet, a hose interface adapted to mount a vacuum hose and pivotally mounted on the housing for selective fluid communication with the inlet, and a suction source in fluid communication with the recovery tank to draw fluid through the hose interface and the recovery tank when the hose interface is in communication with the inlet.

In one embodiment, the hose interface can be moveable between a first position, in which the hose interface is coupled with the recovery tank, and a second position, in which the hose interface is removed from the recovery tank. The hose interface can comprise a latch and the recovery tank can comprise a latch receiver that is adapted to receive the latch when the hose interface is in the first position to thereby secure the hose interface in the first position. The latch can comprise a catch and the latch receiver can comprise a lip that is adapted to receive the catch when the hose interface is in the first position to thereby secure the hose interface in the first position. The latch is movable between a lip retraining position against the lip and a lip release position away from the lip and is biased to the lip retaining position to secure the hose interface in the first position when the hose interface is in the first position. The hose interface can further comprise a door, and the latch can be moveably mounted to the door.

In another embodiment, the hose interface can comprise a hose adapter and a door, and the hose adapter can be removably mounted to the door. The hose adapter can comprise a conduit forming a through opening for fluid connection with the vacuum hose. The conduit can comprise a recess that is adapted to receive a solution conduit.

In yet another embodiment, the vacuum cleaner can further comprise a gasket positioned at the inlet and adapted to seal the recovery tank to the hose interface. The vacuum cleaner can further comprise a diverter valve that is moveable between a dry mode position and a wet mode position and that is coupled to the gasket for movement between the dry mode position and the wet mode position.

Further according to the invention, a combination wet-dry vacuum cleaner comprises a recovery tank having an air-liquid separator for separating air from liquid, and a diverter tube adapted for fluid communication with a vacuum hose and forming an inlet to the recovery tank at a first end thereof and having an outlet opening spaced from the first end, wherein the diverter tube is rotatably mounted in the recovery tank for movement between a dry mode position and a wet mode position.

In one embodiment, the recovery tank can comprise first conduit that is in communication with the outlet opening in the diverter tube when the diverter tube is in the dry mode position for directing dry dirt-laden air into a water bath in the recovery tank and a second conduit that is in communication with the air-liquid separator when the diverter tube is in the wet mode position for directing liquid-laden air to the air-liquid separator. In a preferred embodiment, the first and second conduits are integral and the outlet opening is positioned with the integral conduit.

An actuator can be provided on the recovery tank for moving the diverter tube between the dry mode position and the wet mode position. The actuator can comprise a gasket that forms a seal between the recovery tank and a vacuum hose. The vacuum cleaner can further comprise a detent mechanism for releasably retaining the diverter tube in the dry mode position and wet mode position. The detent mechanism can be positioned between the diverter tube and the integral conduit for directing the dry dirt-laden air into a water bath in the recovery tank when the diverter tube is in the dry mode position and for directing liquid-laden air to the air-liquid separator when the diverter tube is in the wet mode position.

DESCRIPTION OF THE PREFERRED EMBODIMENT

Figure 1:
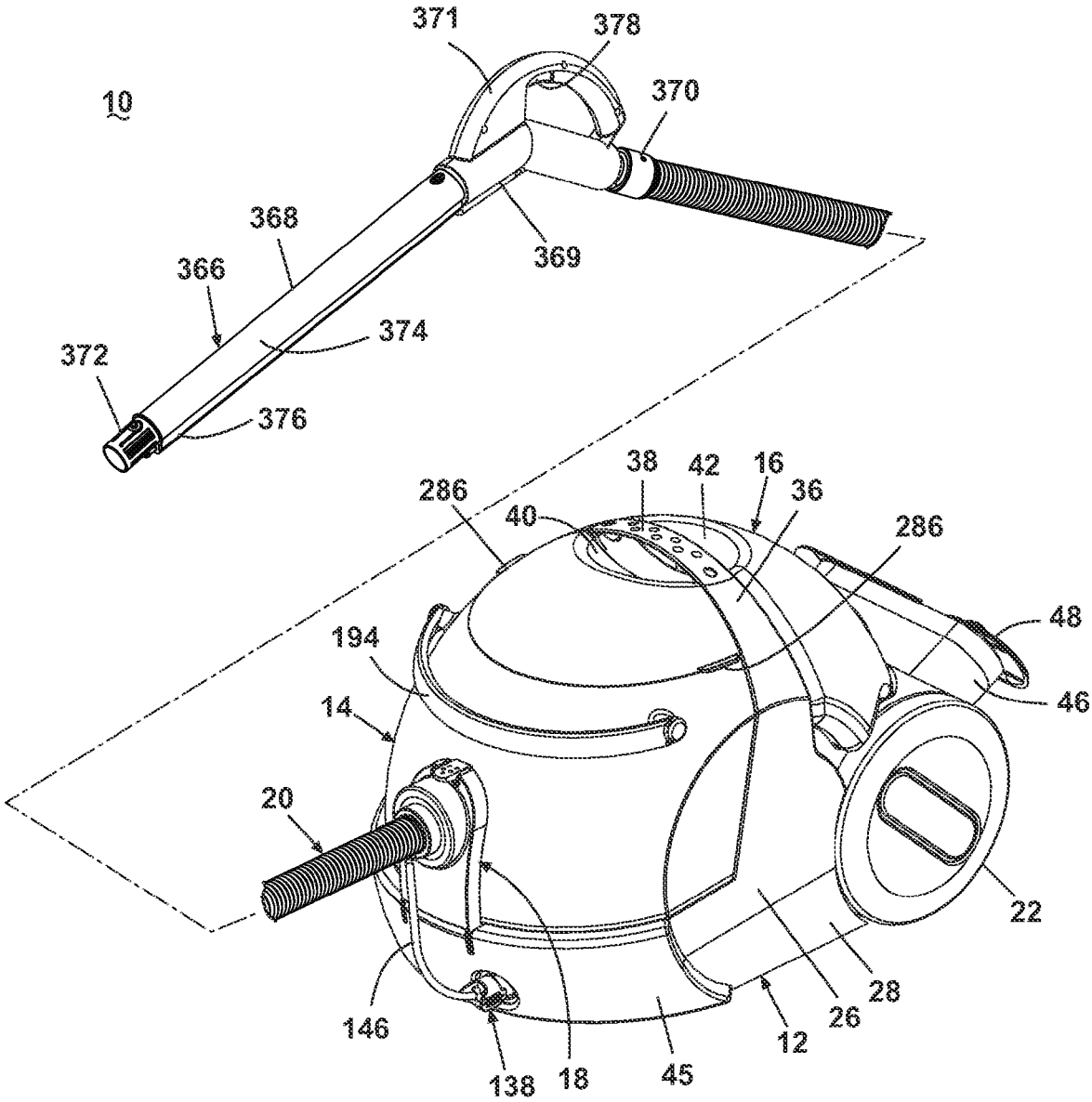
FIG. 1 is a perspective view of a canister vacuum cleaner according to the invention.
Figure 2:
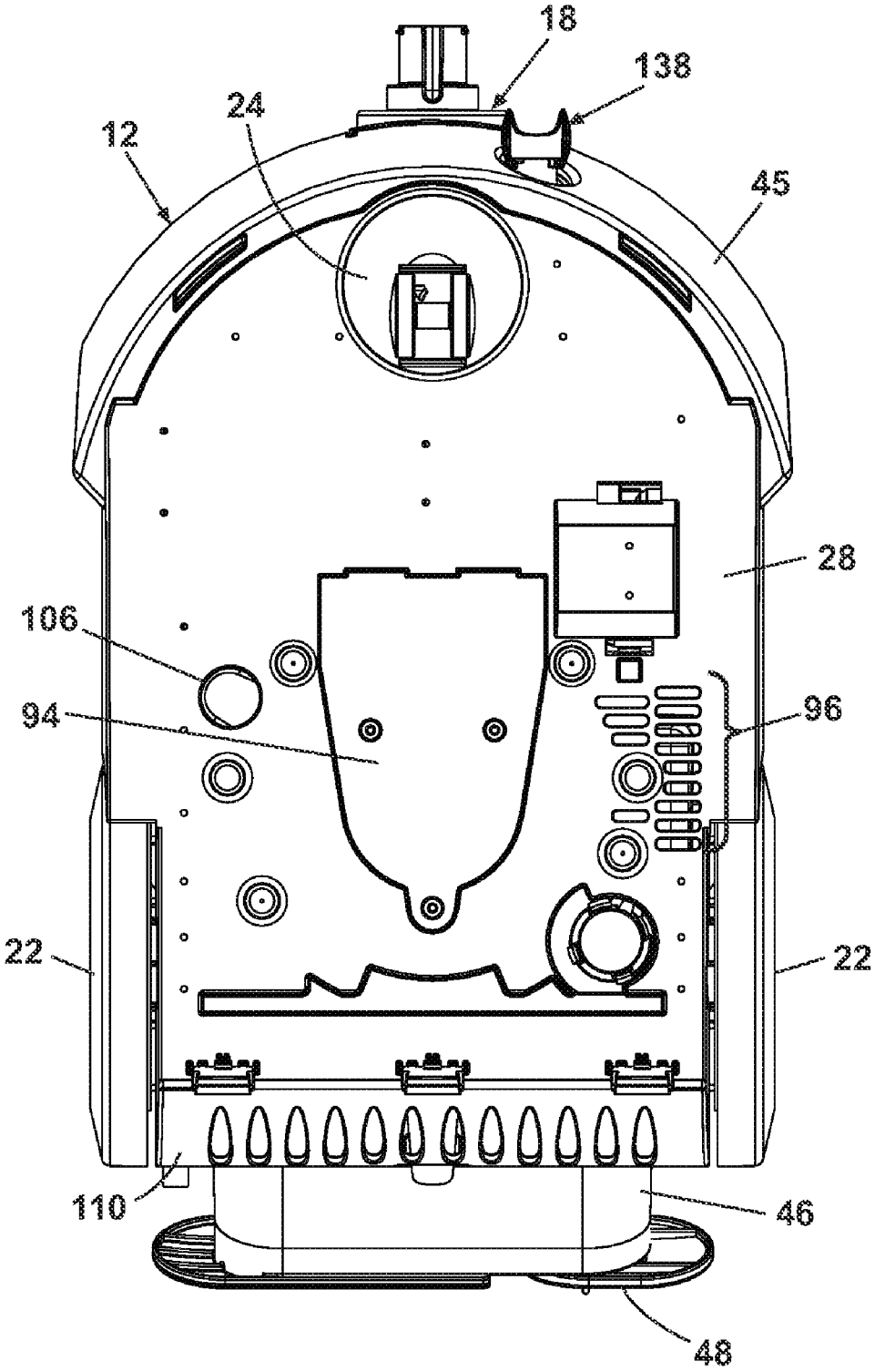
FIG. 2 is a bottom view of the vacuum cleaner from FIG. 1.
Figure 3:
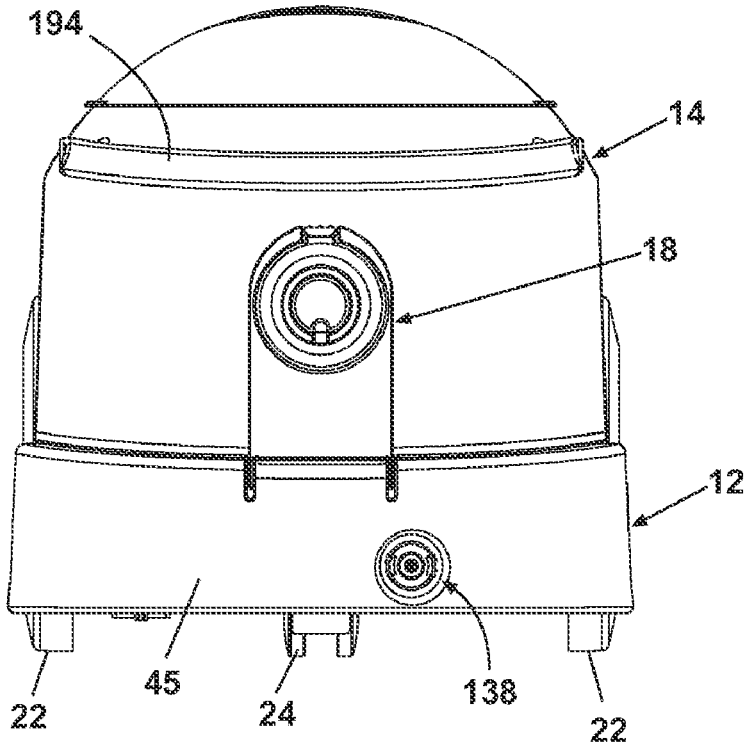
FIG. 3 is a front view of the vacuum cleaner from FIG. 1.

Referring now to the drawings and in particular to FIGS. 1 and 2, a wet/dry canister vacuum cleaner 10 is described comprising a base assembly 12, a recovery tank assembly 14, a solution tank assembly 16, and a hose interface 18 for connecting a commonly known vacuum hose 20. An attachment tool such as a wand, grip, or other accessory tool can be coupled to the vacuum hose for performing a cleaning operation. The vacuum cleaner 10 is mobile, with a pair of rear wheels 22, and a front wheel 24 rotatably coupled to the base assembly 12. The front wheel 24 is preferably a caster wheel for easy maneuvering of the vacuum cleaner 10 on a carpeted surface or on a bare floor. The vacuum cleaner 10 can be used to clean fabric-covered surfaces, such as carpets, rugs, and upholstery, and bare surface, such as hardwood, linoleum, and tile. The vacuum cleaner can further be used for dry vacuuming, wet vacuuming, and extraction. As used herein, the term "dry vacuuming" includes collecting relatively dry dirt and debris from a surface to be cleaned and "wet vacuuming" includes collecting liquids and relatively wet dirt and debris from a surface to be cleaned. "Extraction" cleaning includes delivering a cleaning fluid to a surface to the cleaned, and removing the spent cleaning fluid, dirt and debris from the surface to the cleaned.

Figure 5:
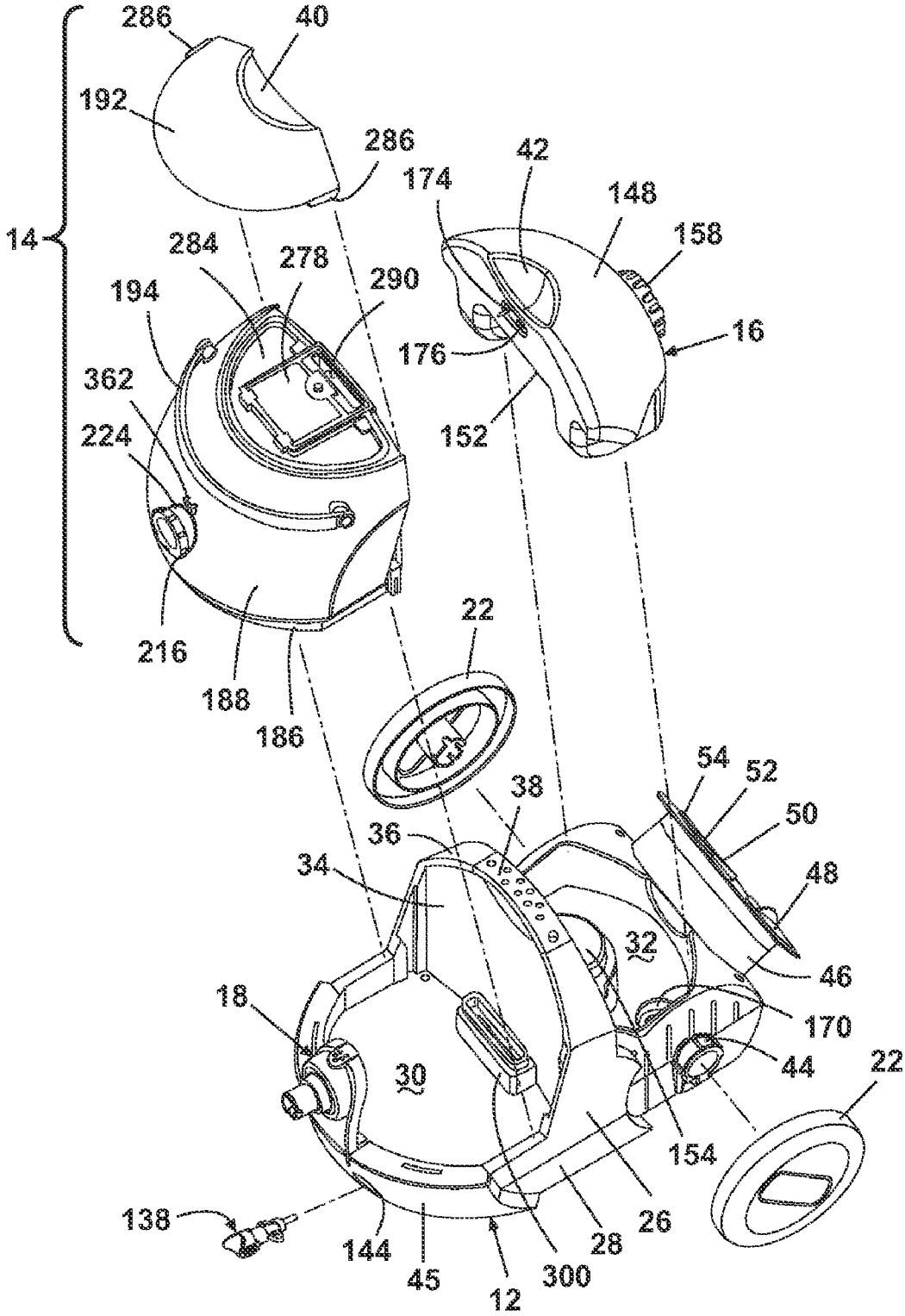
FIG. 5 is an exploded perspective view of the vacuum cleaner from FIG. 1, including a base assembly, a recovery tank assembly and a solution tank assembly.

Referring to FIG. 5, the base assembly 12 comprises an upper base housing 26 mated with a lower base housing 28. The upper base housing 26 includes a recovery tank recess 30 for removably receiving the recovery tank assembly 14 and a solution tank recess 32 for removably receiving the solution tank assembly 16. A vertical partition wall 34 separates the recovery tank recess 30 and the solution tank recess 32 and includes a carry handle 36 for lifting and carrying the vacuum cleaner 10. The carry handle 36 can further comprise a grip portion 38 that can be overmolded with a soft durometer material for providing a comfortable hand grip to the user. Handle depressions 40, 42 are respectively formed in the recovery tank assembly 14 and the solution tank assembly 16 near the carry handle 36 so that the vacuum cleaner 10 can be carried when the recovery tank assembly 14 and the solution tank assembly 16 are mounted to the base assembly 12.

The rear wheels 22 are rotatably attached to the base assembly 12 by axle bearing surfaces 44 on the sides of the lower base housing 28. The lower base housing 28 further comprises a bumper 45 positioned beneath the hose interface 18. A cord mount 46 is attached on the side of the base assembly 12 opposite the bumper 45 for wrapping an electrical cord (not shown) for storage, and comprises a sliding cord wrap 48 that is biased outwardly from the centerline of the vacuum cleaner 10 to maintain the electrical cord on the cord mount 46 and can be moved towards the centerline to remove the electrical cord. Commonly known electrical on/off switches 50, 52, 54 are located on the cord wrap 46 and can be actuated by a hand or foot of the user. The switches control the supply of electrical power to a fluid heater, a suction source, and a fluid pump of the vacuum cleaner 10, as will be described below.

Figure 6:
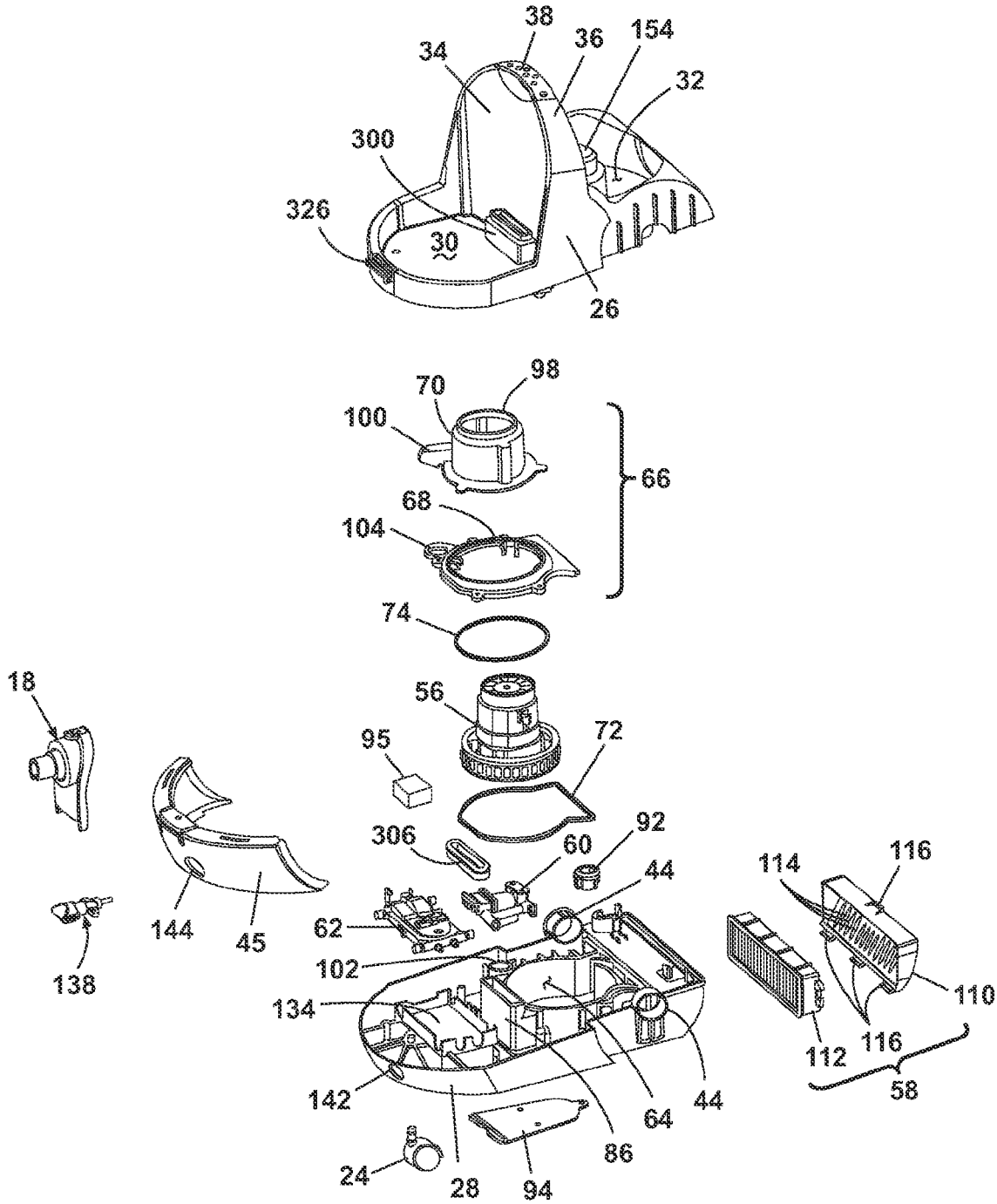
FIG. 6 is an exploded view of the base assembly from FIG. 5
Figure 7:
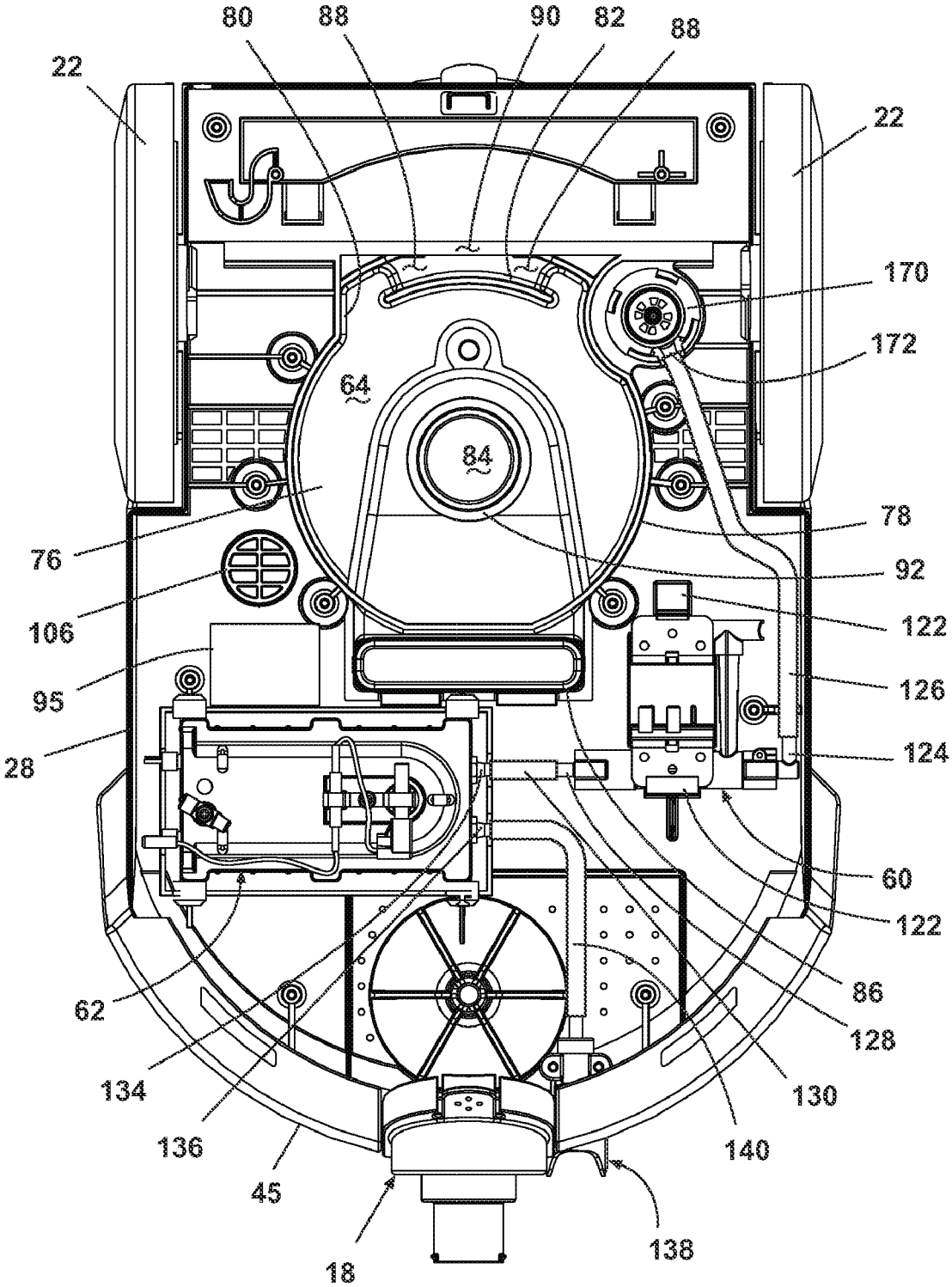
FIG. 7 is a top view of a portion of the base assembly from FIG. 5.

Referring to FIGS. 6 and 7, the upper base housing 26 and the lower base housing 28 define a space therebetween which receives a motor/fan assembly 56 for generating a flow of working air through the vacuum cleaner 10, a post-motor filter assembly 58 for filtering the air exhausted by the motor/fan assembly 56 for it enters the atmosphere, a fluid pump 60 for moving cleaning fluid from the solution tank assembly through the vacuum hose 20 and a fluid heater 62 for raising the temperature of cleaning fluid to be distributed.

The motor/fan assembly 56 is received in a motor/fan assembly housing that comprises a lower cavity 64 integrally formed with the lower base housing 28 and a two-part cover 66 which includes a lower cover 68 that rests on an upper edge of the lower cavity 64 and an upper cover 70 which is fixed to the top of the lower cover 68. A first housing gasket 72 is positioned between the upper edge of the lower cavity 64 and the lower cover 70 and a second housing gasket 74 is positioned between the lower cover 68 and the upper cover 70 to establish an air-tight seal between the components making up the motor/fan assembly housing.

The lower cavity 64 comprises a bottom wall 76 and a generally circular side wall 78 joined with a curved outer air guide wall 80. An inner air guide wall 82 is formed near the curved outer air guide wall 80. An inlet opening 84 to the motor/fan assembly housing formed in the bottom wall 76 and is in communication with a lower recovery tank outlet conduit 86. An exhaust air flow path 88 is formed between the inner air guide wall 82 and the outer air guide wall 80 and is in communication with an outlet opening 90 from the motor/fan assembly housing is formed in the outer air guide wall 80. A motor gasket 92 is positioned between the inlet opening 84 and the motor/fan assembly 56. A sealed access door 94 is provided on the lower base housing 28 and can be removed to the access the air duct as necessary to clean and remove clogs. An EMI (electromagnetic interference) filter 95 is positioned in the base assembly 12 to remove unwanted electromagnetic interference created by the electrical components.

Referring to FIGS. 2 and 6, motor cooling air is drawn into the motor/fan assembly housing through a plurality of inlet openings 96 formed in the underside of the lower base housing 28 through which cooling air from the atmosphere is drawn by a cooling fan. The cooling air enters the motor/fan assembly housing through an open top 98 of the upper cover. After passing over the motor/fan assembly 56, the cooling air is exhausted to the atmosphere through a first cooling conduit 100 integrally formed with the upper cover 70 and a second cooling conduit 102 integrally formed with the lower base housing 28 and joined with the first cooling conduit 100 through an aperture 104 in the lower cover 68. The second cooling conduit 102 has an outlet opening 106 formed in the underside of the lower base housing 28. A filter (not shown) can optionally be positioned between the inlet openings 96 and the motor/fan assembly 56 to remove debris from the cooling air before it is used to cool the motor/fan assembly 56. A filter (not shown) can also optionally be positioned between the motor/fan assembly 56 and the outlet opening 104 to remove debris from the cooling air before it reenters the atmosphere.

Figure 8:
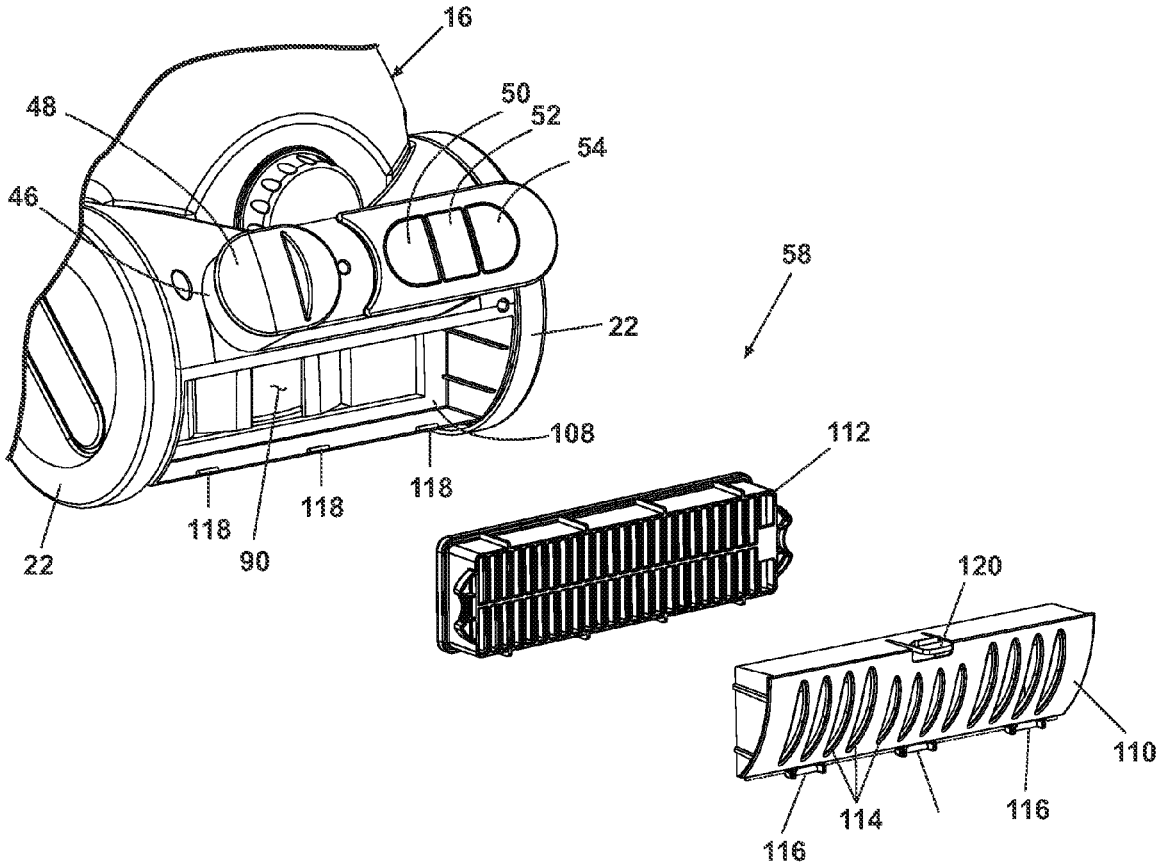
FIG. 8 is a rear view of the vacuum cleaner from FIG. 1, illustrating a post-motor filter assembly in an exploded orientation.

Referring to FIG. 8, the post-motor filter assembly 58 comprises filter chamber 108 formed in the lower base housing 28 between the rear wheels 22 and beneath the cord mount 46, and is closed by a removable filter chamber door 110. The filter chamber 108 receives a filter 112, which can be a HEPA filter, and is in fluid communication with the outlet opening 90 from the motor/fan assembly housing for filtering the air exhausted from the motor/fan assembly 56 before it enters the atmosphere through a plurality of grill openings 114 formed in the filter chamber door 110. The filter chamber door 110 further comprises a plurality of tabs 116 that are snap fit into corresponding slots 118 (partially shown) on the lower base housing 28 to secure the filter chamber door 110 thereto and a resilient detent latch 120 for easy removal of the filter chamber door 110 to gain access to the filter 112 for cleaning or replacement as necessary.

Referring to FIGS. 6 and 7, the fluid pump 60 is mounted within a pump cavity 122 integrally formed in the lower base housing 28 and comprises a pump inlet 124 in fluid communication with the solution tank assembly 16 via a first fluid line 126 and a pump outlet 128 in fluid communication with the fluid heater 62 via a second fluid line 130. More specifically, the fluid heater 62 is mounted within a heater cavity 132 integrally formed in the lower base housing 28 and comprises a heater inlet 134 in fluid communication with the pump outlet 128 via the second fluid line 130. The fluid heater 62 further comprises a heater outlet 136 in fluid communication with a coupler assembly 138 via a third fluid line 140. The fluid heater 62 is preferably located upstream of the fluid pump 60, however, the fluid heater 62 can also be located downstream of the fluid pump 60. Optionally, the fluid heater 62 can be eliminated and the pump outlet 128 can be in direct fluid communication with the coupler assembly 138.

Referring to FIGS. 1 and 6, the coupler assembly 138 is provided on a front portion of the base assembly 12 to provide an interface for establishing a path for transporting cleaning solution from the solution tank assembly 18 to a commonly known fluid distributor (not shown) that distributes cleaning solution to a surface to be cleaned. The coupler assembly 138 further comprises a male portion 139 that is releasable from and in fluid communication with a female portion 141. The female portion 141 is mounted within the base assembly 12, with a portion of the female portion 141 protruding exteriorly of the base assembly 12 through a pair of aligned openings 142, 144 in the lower base housing 28 and the bumper 45. The male portion 139 is fixedly attached to an end of a solution conduit 146 and comprises a commonly known normally closed valve that is biased to a closed position in which the flow of cleaning fluid blocked through the male portion 139 and is moveable to an open position in which cleaning fluid flows through the male portion 139 and the female portion 141 when the portions 139, 141 are coupled. Preferably, the coupler assembly 138 is configured to automatically move to the open position upon connection of a solution conduit 146 in fluid communication with a solution conduit of the vacuum hose 20.

Figure 9:
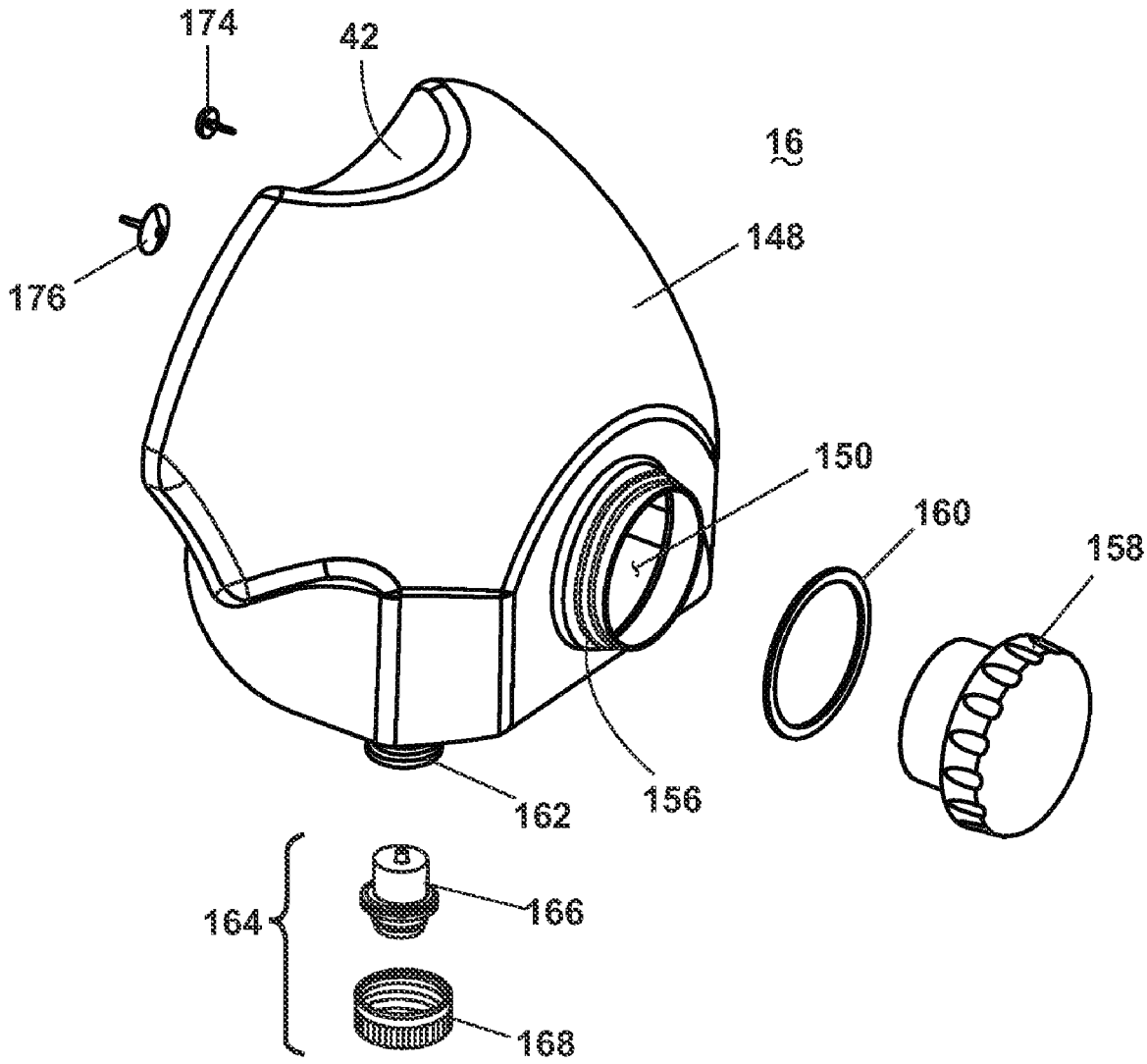
FIG. 9 is an exploded view of the solution tank assembly from FIG. 5

Referring to FIGS. 5 and 9, the solution tank assembly 16 comprises a solution tank 148 defining a solution chamber 150 for storing a supply of cleaning fluid. The cleaning fluid can comprise any suitable cleaning fluid, including, but not limited to, water, concentrated detergent, diluted detergent, and the like. Preferably, the cleaning solution comprises a combination of water and detergent. The solution tank 148 has a recessed portion 152 shaped to complement the outer shape of the solution tank recess 32, which includes a stepped portion 154 for accommodating the motor/fan assembly 56 within the base assembly 12. The solution tank 148 is further formed with a first threaded opening 156 for receiving a removable fill cap 158 with a predetermined volume that can also be used to measure a predetermined amount of cleaning solution as is commonly known. The fill cap 158 includes a gasket 160 for establishing a fluid-tight seal on the first threaded opening 156. To fill the solution tank 148, the user removes the fill cap 158 and pours cleaning fluid into the predetermined volume. The measured cleaning fluid is then poured through the first threaded opening 156. A second threaded opening 162 is located on the bottom of the solution tank 148 and receives a commonly known valve assembly 164 comprising a normally closed valve 166 and a valve retainer 168 for mounting the normally closed valve 166 to the second threaded opening 162. The valve assembly 164 is connected with a valve receiver 170 in the base assembly 12 when the solution tank assembly 12 is mounted within the solution tank recess 32.

Referring additionally to FIG. 7, the valve receiver 170 comprises a valve receiver outlet 172 that is in fluid communication with the pump inlet 124 via the first fluid line 126. The normally closed valve 166 is biased to a closed position in which cleaning fluid cannot flow through the valve assembly 164 when the solution tank assembly 16 is removed from the solution tank recess 32 and is automatically moved to an open position in which cleaning fluid flows through the valve assembly 164 upon connection of the valve assembly 164 with the valve receiver 170. A pair of commonly known umbrella valves selectively seal ambient air from the interior of the solution tank 148. A vent valve 176 vents ambient air into the solution tank 148 during use, thus facilitating the flow of fluid out of the solution tank 148 in a normal manner but prevents the contents of the solution tank 148 from exiting the solution tank 148. An overpressure valve 176 prevents ambient air from entering the solution tank 148 during normal use, but vents excess pressure within the solution tank 148 to ambient. Over pressure situations can arise when certain reactive solutions such as hydrogen peroxide are used.

Figure 10:
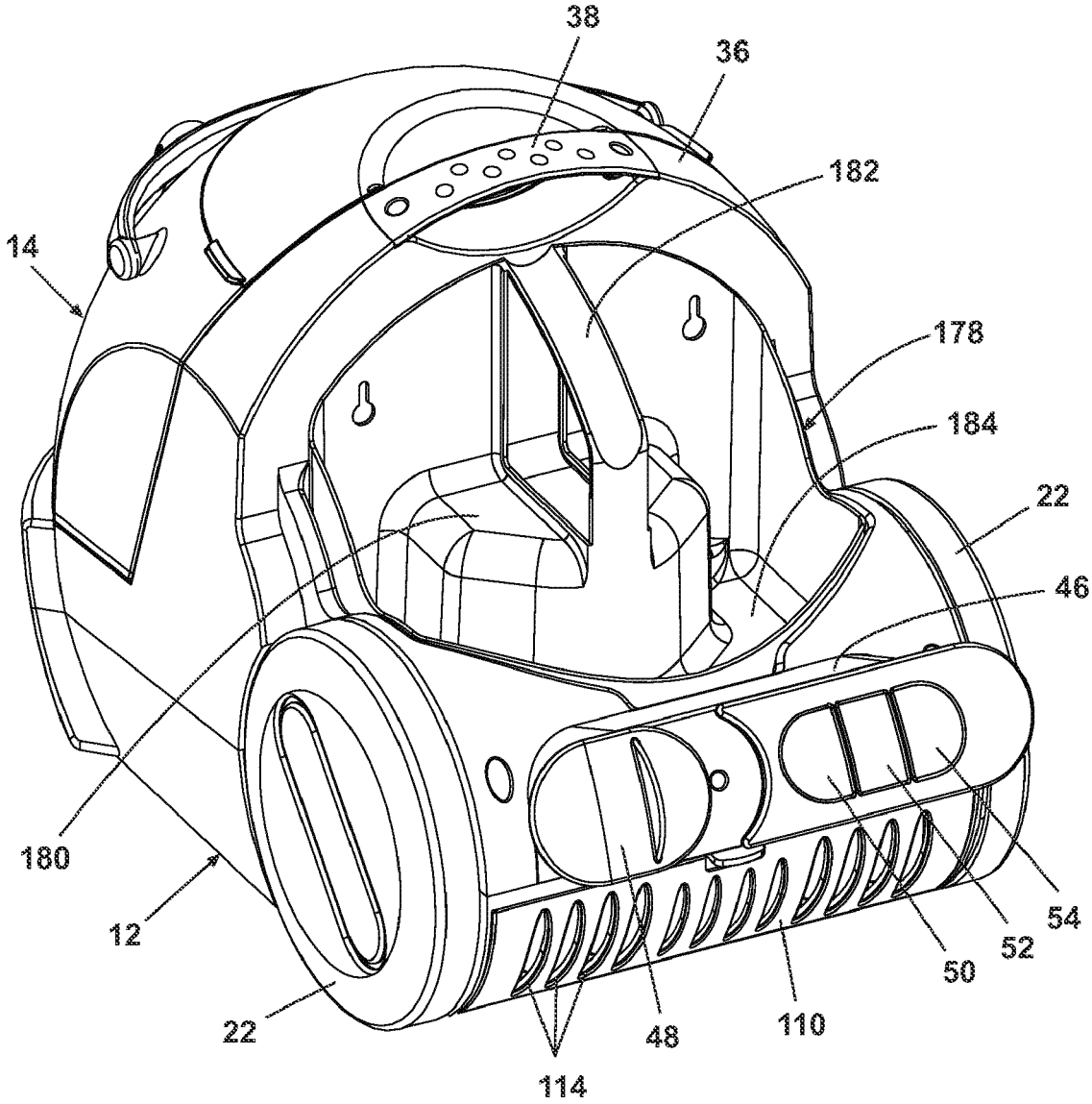
FIG. 10 is a rear perspective view of a tool caddy for the vacuum cleaner that is interchangeable with the solution tank assembly.

Referring to FIG. 10, a tool caddy 178 can be mounted in the solution tank recess 32 in lieu of the solution tank assembly 16. Since the solution tank assembly 16 is not used during dry vacuum cleaning, it is convenient to have accessory tools used for dry vacuum cleaning readily available that can be attached to the vacuum hose 20. This interchangeability reduces the size and weight of the vacuum cleaner 10 for cleaning operations since the solution tank assembly 16 and the tool caddy 178 are separately used. The tool caddy 178 has substantially the same external side and lower shape as the solution tank 148 (FIG. 9) and comprises a recessed portion 180 that is shaped to complement the outer shape of the stepped portion 154 (FIG. 5). The tool caddy 178 further comprises a handle 182 and an open pocket 184 in which accessory tools can be conveniently stored and quickly accessed.

Figure 11:
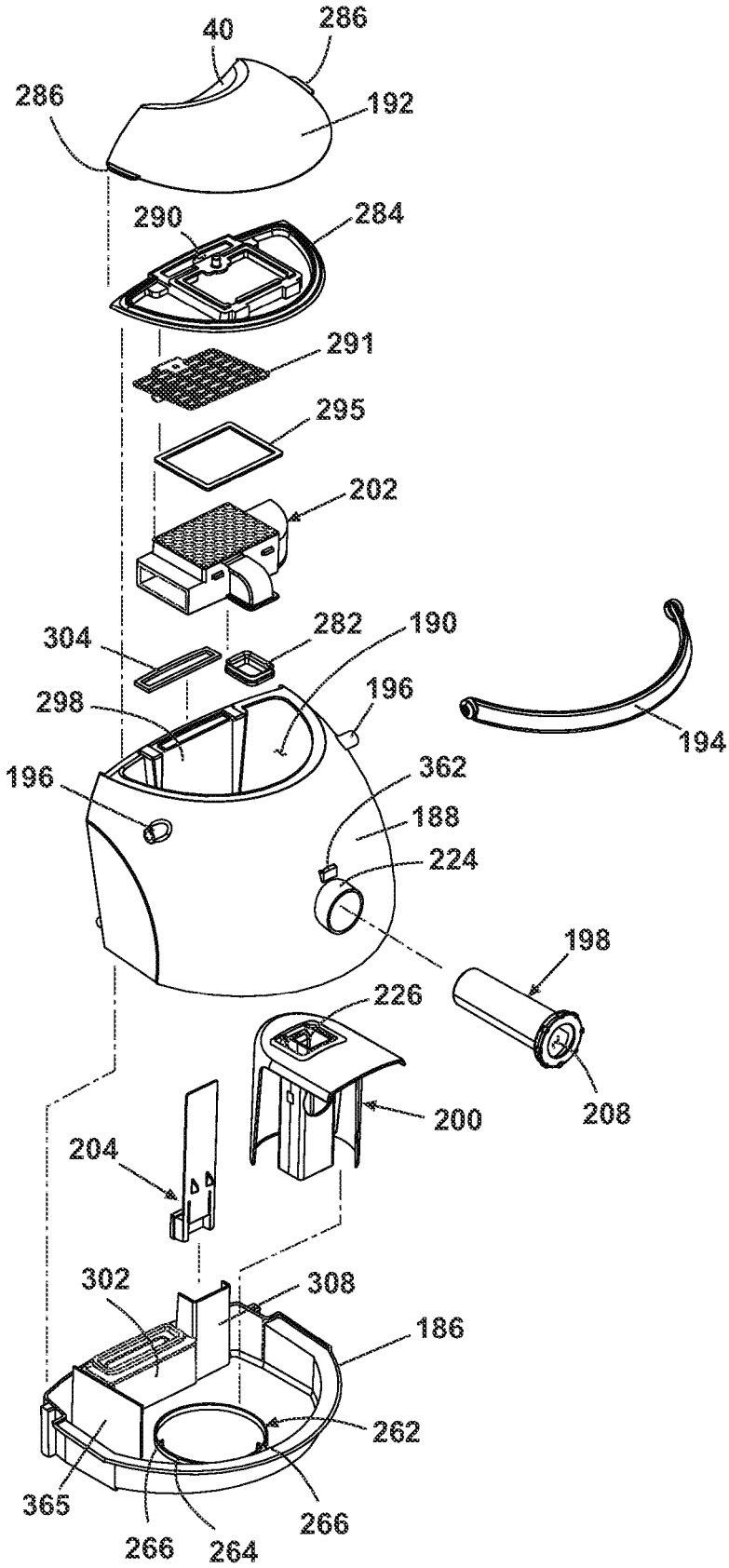
FIG. 11 is an exploded view of the recovery tank assembly from FIG. 5, including a diverter assembly, a duct assembly, a separator assembly and a float assembly.

Referring to FIG. 11, the recovery tank assembly 14 comprises an bottom casing 186 joined with an upper casing 188 to form a single recovery chamber 190 that is closed by a removable cover 192 and in which debris and fluid can be collected. The recovery chamber 190 is adapted to hold a predetermined amount of fluid, which can be a water bath that serves as a first-stage filter for debris-containing air when performing dry vacuuming or can be recovered fluid when performing wet vacuuming or extraction cleaning. Although the vacuum cleaner 10 is most effective when a water bath filter is used, it can also be operated with an empty recovery chamber 190 when performing dry vacuuming. At least a portion of the bottom casing 186, upper casing 188, and/or the cover 192 are preferably transparent or semi-transparent to allow the contents of the recovery chamber 190 to be viewed by a user. A recovery tank handle 194 is rotatably coupled at either end with a pair of pivot shafts 196 formed on the upper casing 188 and can be used to carry the recovery tank assembly 14 when it is removed from the vacuum cleaner 10.

The recovery tank assembly 14 further comprises a diverter assembly 198 for switching operational modes of the vacuum cleaner 10, a duct assembly 200 that cooperates with the diverter assembly 198 to direct incoming liquid and/or air, a separator assembly 202 for removing debris from relatively dry air and also for directing incoming liquid and air in cooperation with the diverter assembly 18 and the duct assembly 220, and a float assembly 204 for preventing liquid from entering the portion of the separator assembly 202 for removing debris from relatively dry air.

Figure 12:
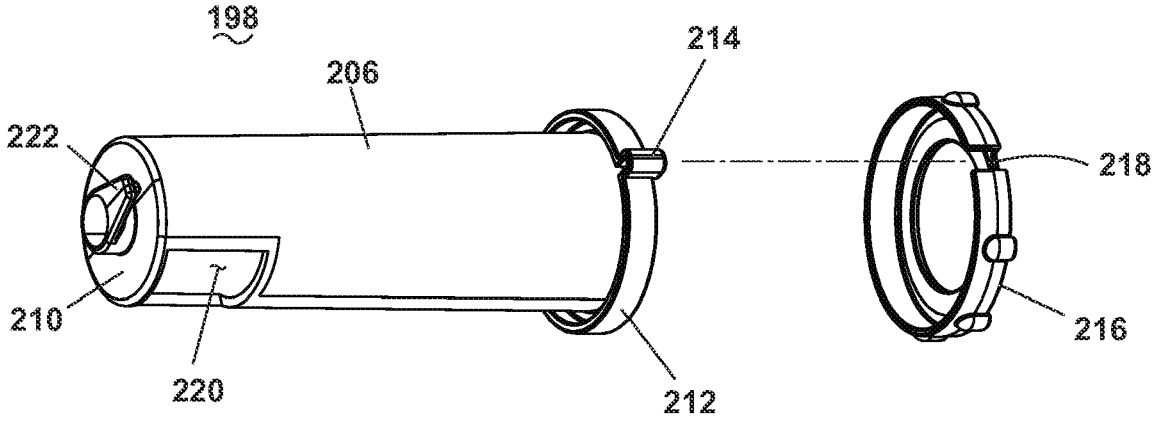
FIG. 12 is an exploded view of the diverter assembly from FIG. 11.

Referring to FIGS. 11 and 12, the diverter assembly 198 is provided for switching operational modes of the vacuum cleaner 10 between a dry mode and a wet mode. The dry mode is used when performing dry vacuuming and the wet mode is used when performing wet vacuuming or extraction cleaning. The diverter assembly 198 comprises an elongated hollow diverter tube 206 having a first open end 208 and a second closed end 210. An annular flange 212 is formed around the first open end 208 and comprises a tab 214 extending outwardly from the flange 212. An annular diverter gasket 216 is positioned on the flange 212 and comprises a cut-out portion 218 that is received by the tab 214, so that the diverter tube 206 is rotatably fixed with the diverter gasket 216. Preferably the diverter gasket 216 is overmolded on to the flange 212, however, the diverter gasket 216 can also be formed as a separate piece that is bonded to the flange 212 in a conventional manner. A diverter opening 220 is formed in the side wall of the tube 206 near the second closed end 210 and is in fluid communication with the duct assembly 200. A rotation hook 222 is formed on the second closed end for rotatably coupling the diverter assembly 198 to the duct assembly 200. A diverter receiver conduit 224 is provided on the upper casing 188 for receiving the diverter assembly 198. The vacuum cleaner 10 can selectively be switched between the dry and wet modes of operation by rotating the tube 206 using the diverter gasket 216 to change to position of the diverter opening 220 in relation to the duct assembly 200, as will be presently described. Markings can be included on the diverter gasket 216 or on the upper casing 188 to indicate the selected mode to the user. Optionally, markings can be added directly on the tube 206 to indicate wet or dry mode. This is particularly useful when the upper casing 188 is made of a transparent material.

Figure 13:
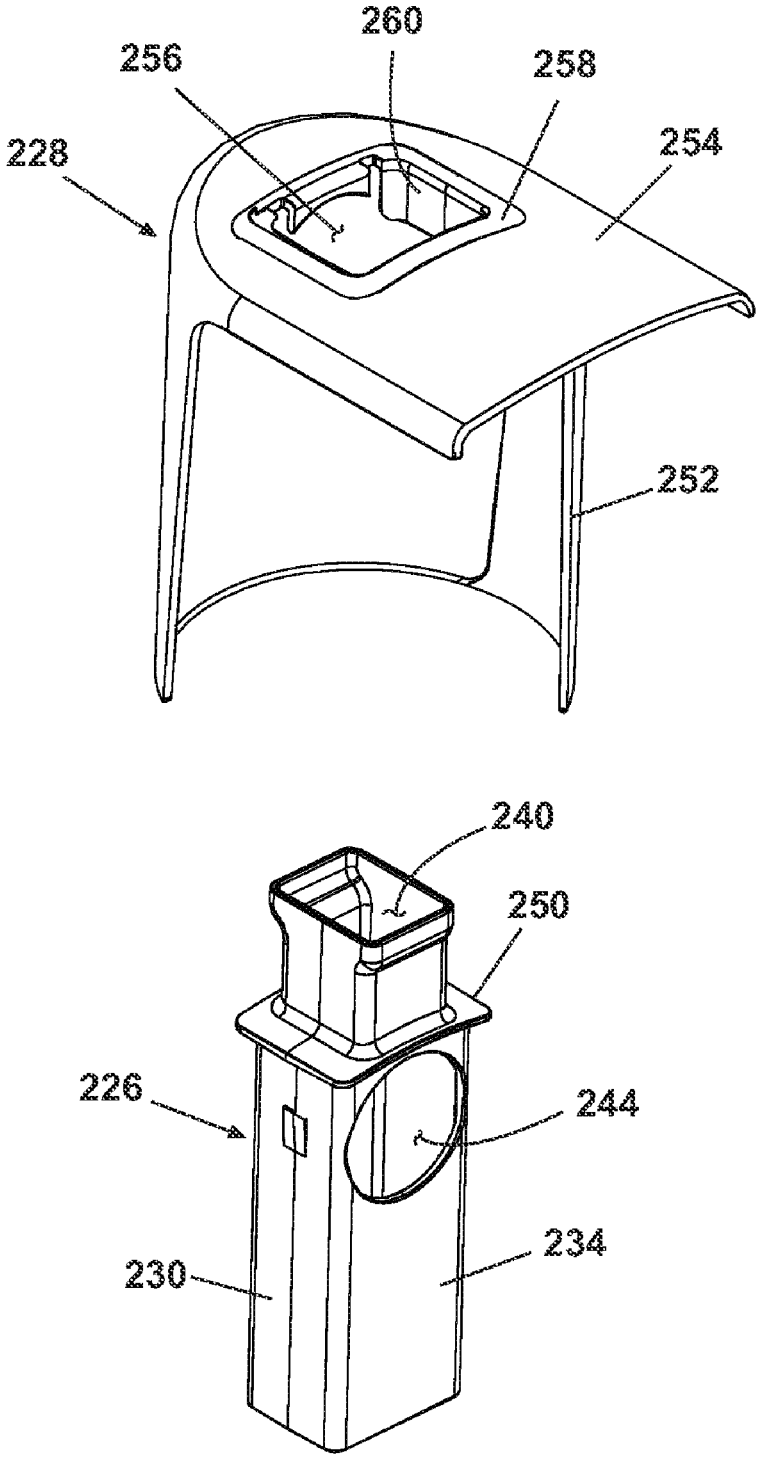
FIG. 13 is an exploded view of the duct assembly from FIG. 11.
Figure 14:
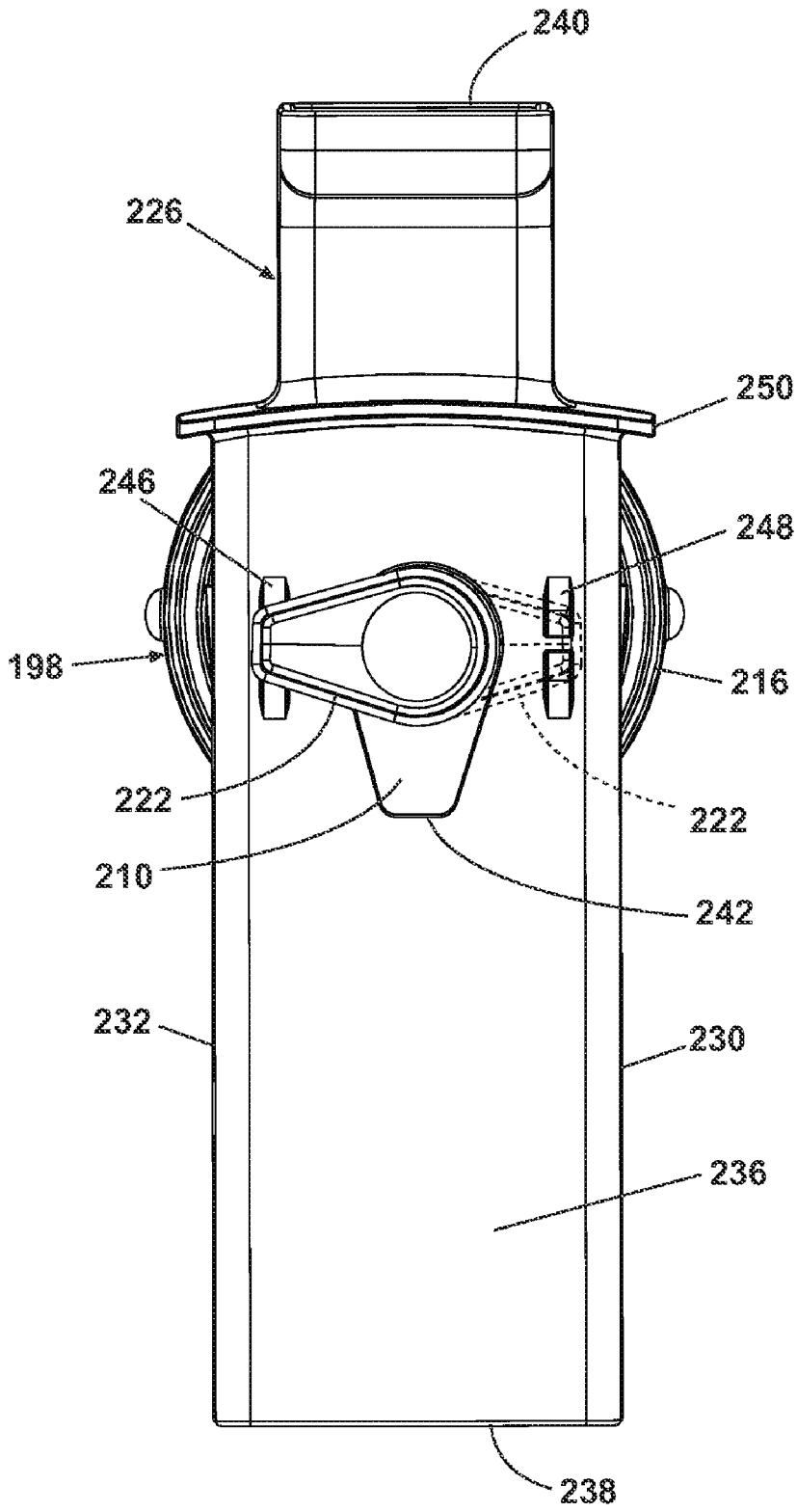
FIG. 14 is a front view of the duct assembly of FIGS. 11 and 13.

Referring to FIGS. 11, 13 and 14, the duct assembly 200 comprises a vertically-oriented duct 226 and a shroud 228 that partially surrounds the inlet duct 226. The duct 226 has a generally rectangular cross-section, although other configurations are possible, and comprises a pair of spaced side walls 230, 232 joined with a front wall 234 and a rear wall 236. The duct 226 is open at both ends to form an air outlet 238 at the lower end and a liquid outlet 240 at the upper end. A key-shaped opening 242 is formed in the rear wall 236 and a circular opening 244 is formed in the front wall 234 for receiving the diverter tube 206, with the second closed end 210 positioned against the inner surface of the rear wall 236 and the rotation hook 22 protruding through the key-shaped opening 242. Two hook retainers 246, 248 are formed on either side of the key-shaped opening 242 and selectively retain the rotation hook 222 during dry mode cleaning and wet mode cleaning. The first hook retainer 246 retains the rotation hook 222 during wet mode cleaning and the second hook retainer 248 retains the rotation hook 222 during dry mode cleaning. A shroud flange 250 is formed on the duct 226 and is positioned above the openings 242, 244 and below the liquid outlet 240. The diverter assembly 198, the duct 226 and the shroud 228 are configured for selective removal from the recovery chamber 190. The diverter assembly 198 is rotatably mounted so that the hook 222 aligns with the key-shaped opening 242 and can be removed by pulling straight out. With the diverter assembly 198 removed, the duct 226 and shroud 228 and can also be removed from recovery tank 190 to clear the recovery tank 190 for easy cleaning.

The shroud 228 comprises a semi-circular side wall 252 joined with an upper wall 254. An opening 256 is formed in the upper wall 254 for receiving the duct 226 and a peripheral recess 258 is formed around the opening 256 in which the shroud flange 250 rests. A support flange 260 depending downward from the periphery of the opening 256 further supports the duct 226. A shroud retainer 262 is formed on the bottom casing 186 and comprises a low circular wall 264 having two inwardly facing stops 266 that engage the semi-circular side wall 252 to maintain the position of the shroud 228 within the recovery chamber 190. During dry vacuuming, introduction of air into a water bath in the recovery chamber 190 creates turbulent flow in the recovery tank assembly 14. The shroud 228 prevents any liquid from splashing up and potentially entering the separator assembly 202.

Figure 15:
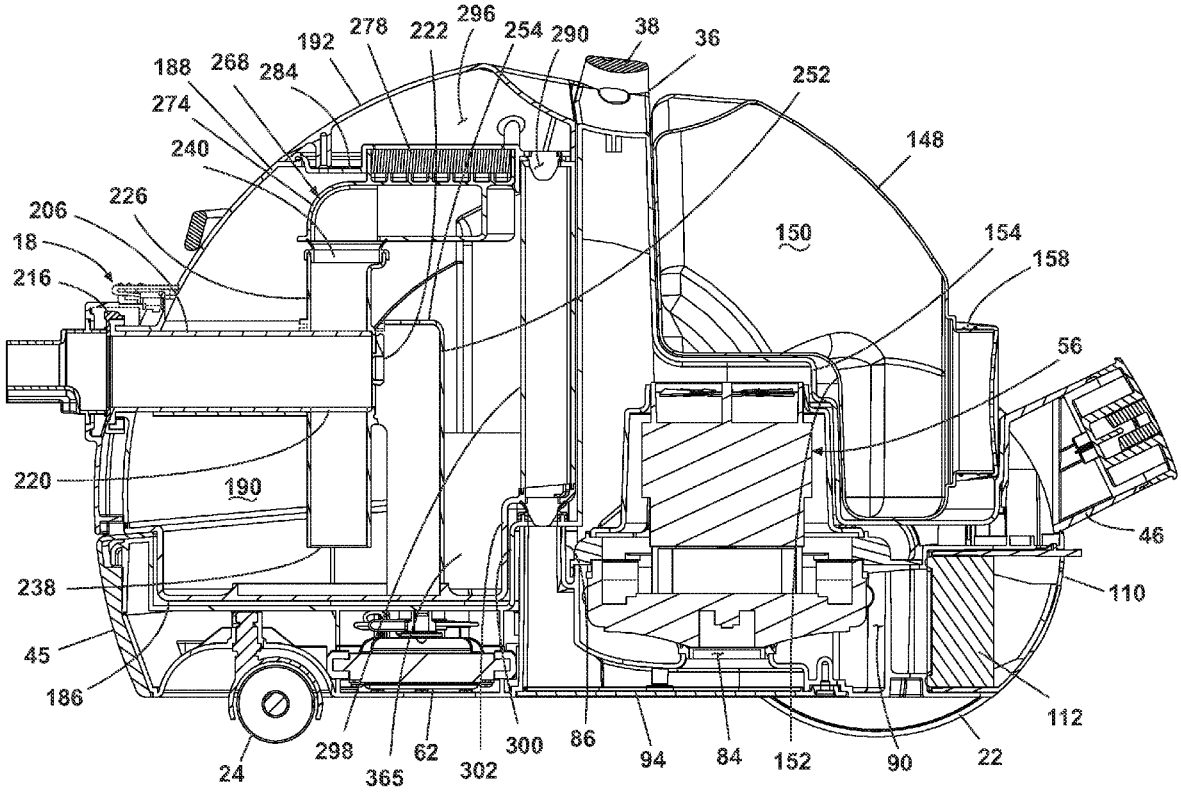
FIG. 15 is a cross-sectional view of the vacuum cleaner, illustrating the diverter assembly in a dry mode position.
Figure 16:
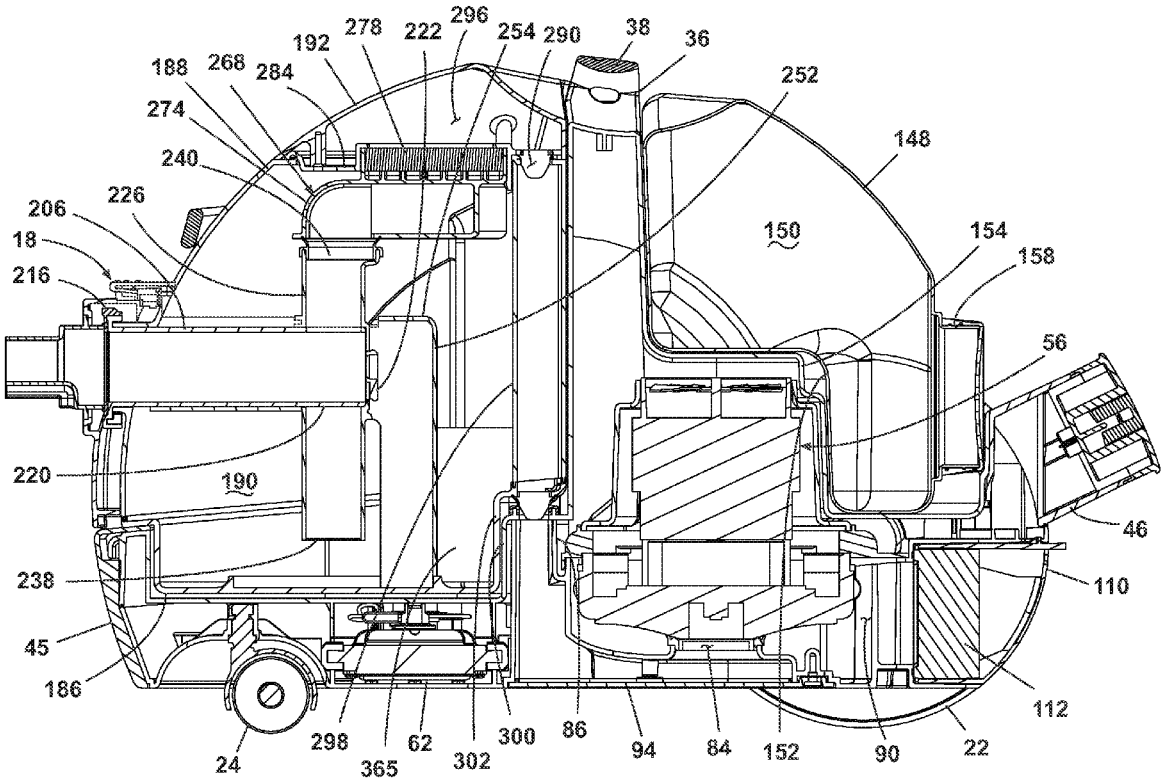
FIG. 16 is a cross-sectional view of the vacuum cleaner, illustrating the diverter assembly in a wet mode position.

Referring to FIGS. 14-16, to position the diverter assembly 198 for dry mode cleaning, the diverter tube 206 is rotated so that the rotation hook 222 is retained by the first hook retainer 246. In this position, the diverter opening 220 is oriented downward in the duct 226 and is in fluid communication with the air outlet 238. To position the diverter assembly 198 for wet mode cleaning, the diverter tube 206 is rotated so that the rotation hook 222 is retained by the second hook retainer 248. In this position, the diverter opening 220 is oriented upward in the duct 226 and is in fluid communication with the liquid outlet 240.

Figure 17:
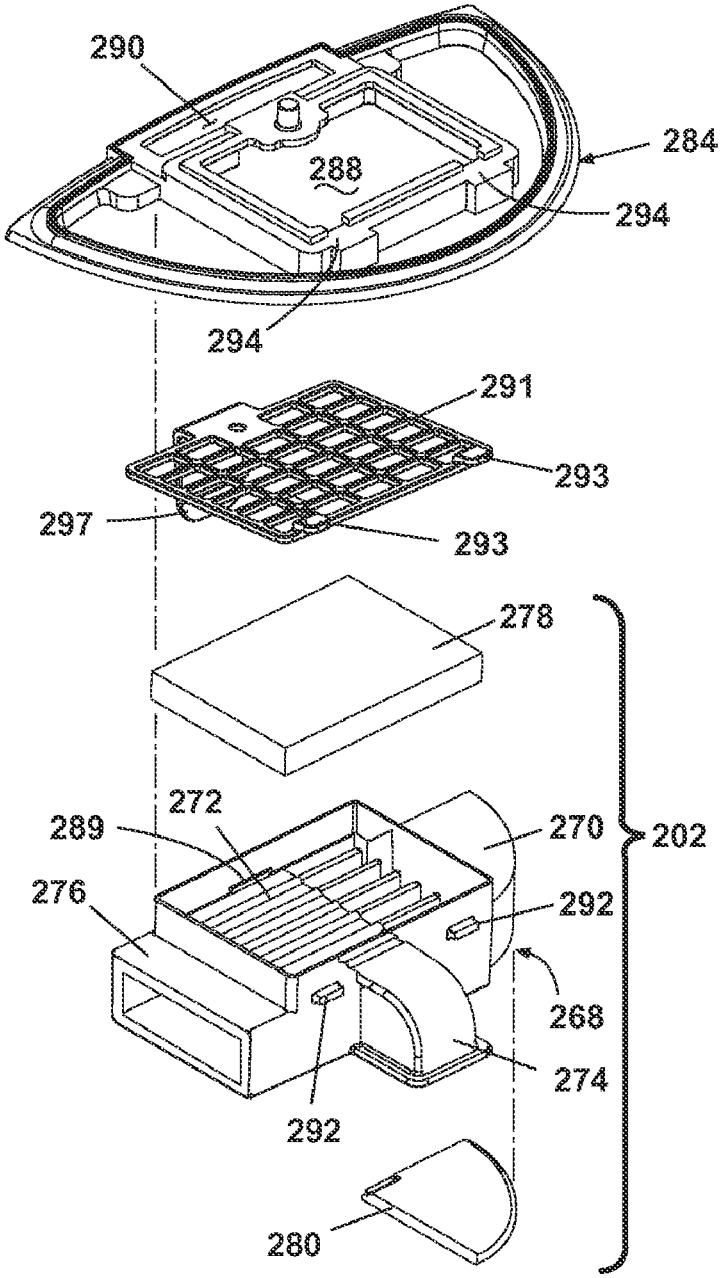
FIG. 17 is an exploded view of the separator assembly from FIG. 11.

Referring to FIGS. 11 and 17, the separator assembly 202 forms a portion of an air-liquid separation pathway and further incorporates a second-stage filter for working air exiting the recovery tank assembly 14. The separator assembly 202 comprises a separator housing 268 having an air inlet conduit 270, a filter chamber 272, a liquid inlet conduit 274, and a liquid guide conduit 276. The air inlet conduit 270 is in fluid communication with the filter chamber 272, which receives a removable foam filter 278. A separate plate 280 is attached to the separator housing 268 to form the bottom portion of the air inlet conduit 270. During dry or wet mode cleaning, relatively dry air from the single recovery chamber 190 flows through the air inlet conduit 270 and the filter chamber 272, where the foam filter 278 removes any debris remaining in the working air that was not collected in the recovery chamber 190. Furthermore, the foam filter 278 can remove any remaining moisture in the working air before it enters the motor/fan assembly 56. A baffle gasket 295 is positioned between the upper edge of the separator housing 268 surrounding the filter chamber 272 and a lower surface of the filter cover 291.

The liquid inlet conduit 274 is in fluid communication with the liquid guide conduit 276 for directing incoming liquid and air out a side of the separator housing 268 and into the recovery chamber 190 during wet mode cleaning. A gasket 282 is positioned between the upper edge of the duct 226 and the liquid inlet conduit 272 to place the liquid inlet conduit 272 in fluid-tight communication with the liquid outlet 240 of the duct assembly 200.

Figure 18:
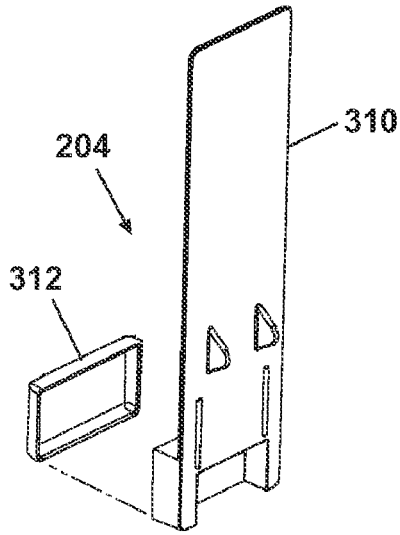
FIG. 18 is an exploded view of the float assembly from FIG. 11.

Referring to FIGS. 17 and 18, the recovery tank assembly 14 further comprises a baffle plate 284 that mounts the separator assembly 202 to the cover 192 and is removable therewith to provide clear access to the recovery chamber 190 when the cover 192 is removed and to facilitate easy emptying of the recovery chamber 190. The cover 192 can further include a pair of lifting grips 286 that enable a user to easily lift the cover 192 from the upper casing 188. The baffle plate 284 comprises a separator housing opening 288 for receiving the separator housing 268 and an outlet opening 290 in fluid communication with the motor/fan assembly 56. The separator housing 268 includes a plurality of inner recesses 292 that receive projections 293 on a filter cover 291 and a detent 289 that retains a projection on (not shown ) on a depending flange 297 to retain the filter 278 within the separator housing opening 288.

Referring to FIG. 16, an open space 296 is formed between the upper surface of the baffle plate 284 and the lower surface of the cover 192 and is in fluid communication with the filter chamber 272 and the outlet opening 290 so that air exiting the separator assembly 202 after passing through the foam filter 278 enters the outlet opening 290.

Referring to FIGS. 6 and 11, an upper recovery tank outlet conduit 298 is integrally formed with the upper casing 188 and is in fluid communication with the outlet opening 290 and the lower recovery tank outlet conduit 86. The upper base housing 26 is formed with a first conduit receiver 300 for fitting around the lower recovery tank outlet conduit 86. The lower casing 186 is in turn formed with a corresponding second conduit receiver 302 for fitting around the first conduit receiver 300 when the recovery tank assembly 14 is seated in the recovery tank recess 30. A first conduit gasket 304 is placed between the outlet opening 290 and the upper recovery tank outlet conduit 298 and a second conduit gasket 306 is placed between the lower recovery tank outlet conduit 86 and the first conduit receiver 300 for creating a fluid-tight pathway extending between the outlet opening 290 and the inlet opening 84 to the motor/fan assembly housing.

Figure 19:
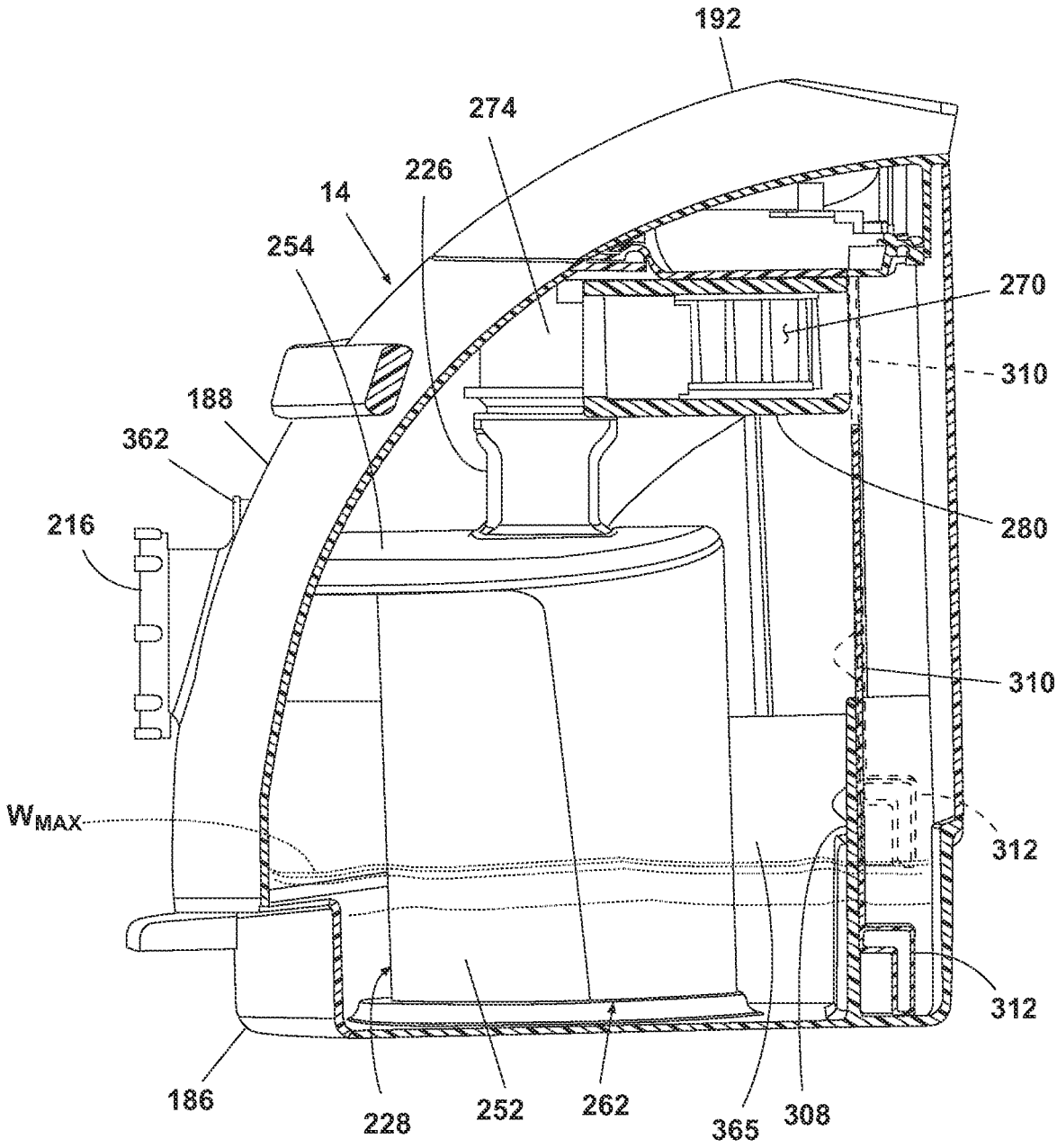
FIG. 19 is a cross-sectional view through the recovery tank assembly, illustrating the movement of the float assembly.

Referring to FIGS. 18 and 19, the float assembly 204 is movably retained in a float assembly housing 308 integrally formed with the bottom casing 52 and comprises a float bar 310 and a float 312 attached to a lower end of the float bar 310. The float bar 310 acts as a valve to close the air inlet conduit 270 and prevent liquid from entering the separator assembly 202. The float bar 310 is operated by the float 312 which rises with the level of the liquid in the recovery chamber 190. As the level of liquid in the recovery chamber 190 reaches a predetermined maximum fill level $W_{MAX}$, the float 312 will rise and the float bar will completely block the air inlet conduit 270.

Figure 20:
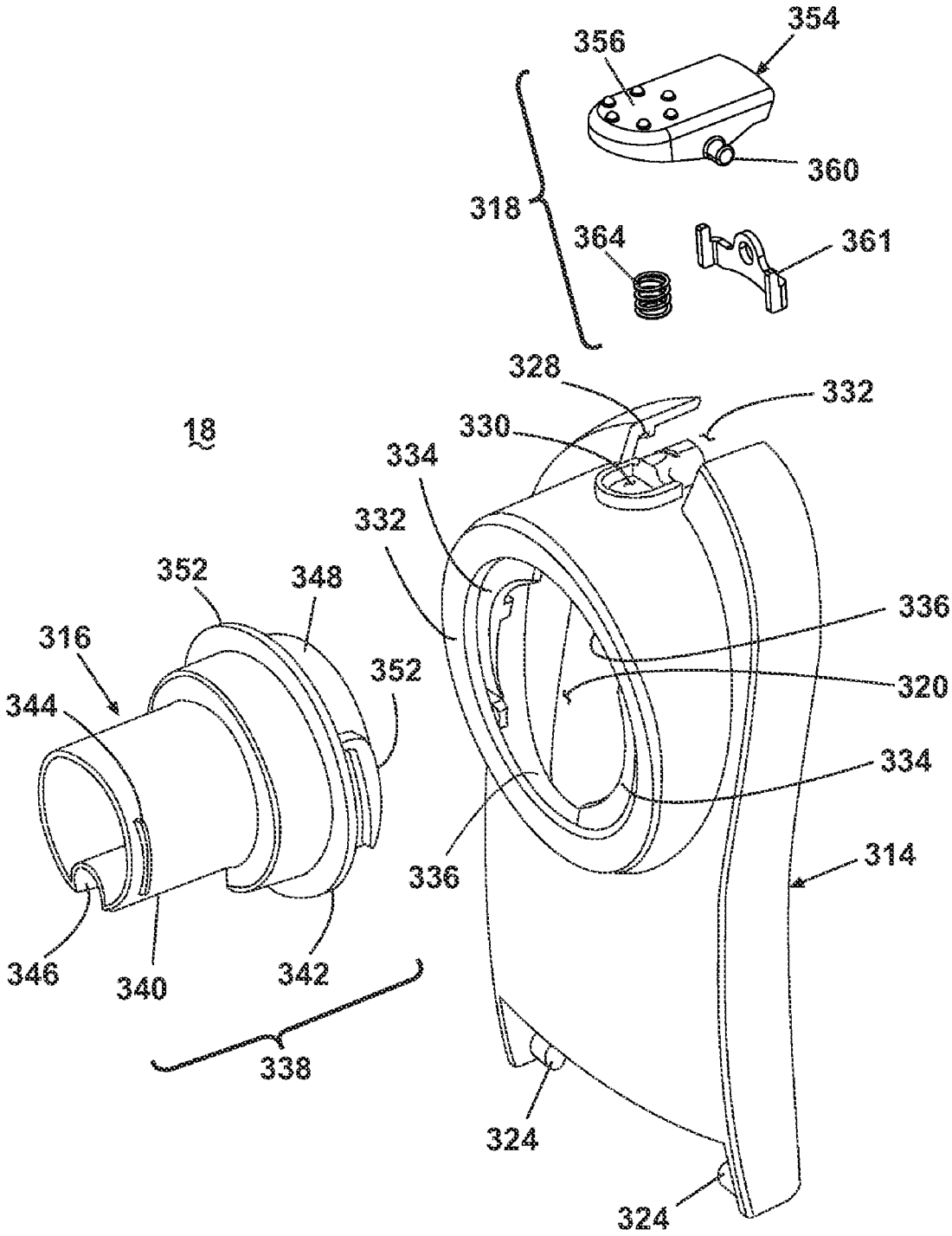
FIG. 20 is an exploded view of a hose interface of the vacuum cleaner.
Figure 21:
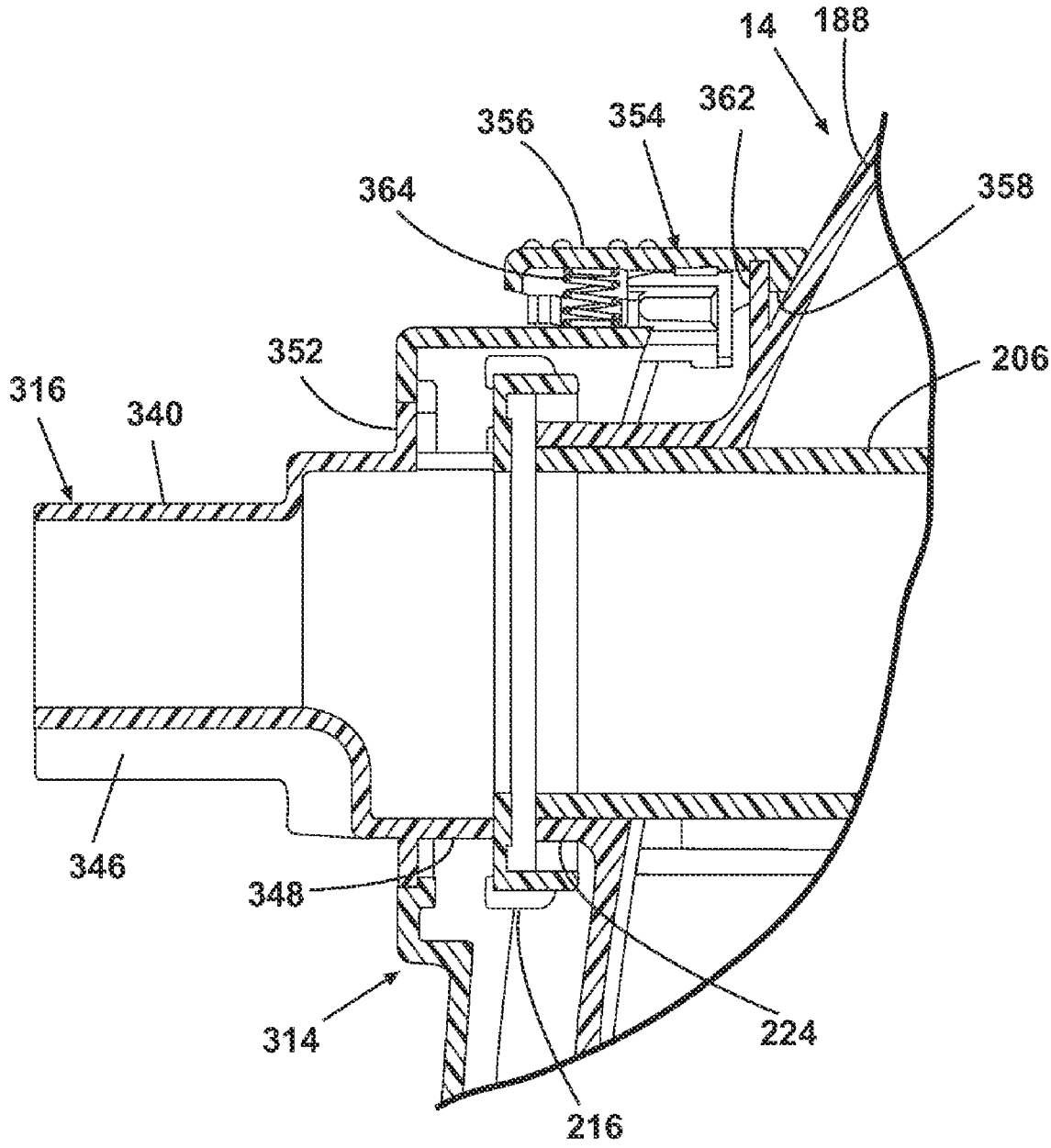
FIG. 21 is a cross-sectional view through line 21-21 of FIG. 1.

Referring to FIGS. 20 and 21, the hose interface 18 comprises a hose door 314, a hose adapter 316 that couples the vacuum hose 20 with the hose interface 18 and a latch assembly 318 that couples the hose door 314 to the recovery tank assembly 14.

The hose door 314 comprises a central opening 320 for receiving the hose adapter 316 and latch recess 322 formed at an upper portion of the hose door 314 for receiving the latch assembly 318. A pair of opposed pivot shafts 324 are formed at a lower portion of the hose door 314, opposite the latch recess 322, and is received by a corresponding hinge 326 (FIG. 6) formed on the upper base housing 26 for rotatably coupling the hose door 314 to the base assembly 12. A pair of latch shaft receivers 328 are formed on either side of the latch recess 322 and a spring cavity 330 is formed forwardly of the latch pivot receivers 328. The hose door 314 further comprises a hose adapter interface 332 for removably receiving the hose adapter 316. The hose adapter interface 332 comprises a pair of opposed lug receivers 334 formed at the periphery of the central opening 320 and having open sectors 336 therebetween.

The hose adapter 316 comprises a hollow body 338 having a hose connector conduit 340 configured to couple with the vacuum hose 20 and a door connector conduit 342 configured to couple with the hose door 314 and integrally formed with the hose connector conduit 340. The hose and door connector conduits 340, 342 can be configured to releasably couple with the vacuum hose 20 and hose door 314, respectively. The hose connector conduit 340 can comprise a pair of ribs 344 that can engage the vacuum hose 20 by a friction fit to retain the vacuum hose 20 on the hose interface 18. Optionally, the vacuum hose 20 can swivel relative to the hose interface 18 to ease moving the vacuum cleaner 10. The hose connector conduit 340 further comprises a solution conduit recess 346 that is adapted to receive and retain a solution conduit, such as the solution conduit 146 (FIG. 1).

The door connector conduit 342 comprises an insertion portion 348 joined with a flange 350. The insertion portion 348 is configured for insertion into the central opening 320 of the hose door 314, with the flange 350 abutting the hose adapter interface 332. A pair of lugs 352 are formed on the insertion portion 348 and releasably engage the lug receivers 334 to couple the hose adapter 316 with the hose door 314. The hose adapter 316 can be coupled with the hose door 314 by a bayonet-type connection, whereby the lugs 352 are first inserted into the open sectors 336 of the hose adapter interface 332 and then twisted into engagement with the lug receivers 334.

The latch assembly 318 comprises a latch 354 having a user-engageable portion 356 formed at one end thereof and a downwardly-depending catch 358 formed at the opposite end thereof. A pair of shafts 360 are provided between the user-engageable portion 356 and the catch 358 and extend from either side of the latch 354 for receipt by the latch shaft receivers 328 to pivotally coupling the latch 354 to the hose door 314. A clamp 361 attached to the hose door 314 helps retain the shafts 360 within the latch shaft receivers 328.

The recovery tank assembly 14 is provided with a corresponding latch receiver for engagement with the latch 354 to secure the hose door 314 to the recovery tank assembly 14. The latch receiver comprises a lip 362 formed above the diverter receiver conduit 224 on the upper casing 188 of the recovery tank assembly 14. A spring 364 between the spring cavity 330 and the underside of the user-engageable portion 356 biases the catch 358 for engagement with the lip 362 to secure the hose door 314 to the recovery tank assembly 14.

Figure 22:
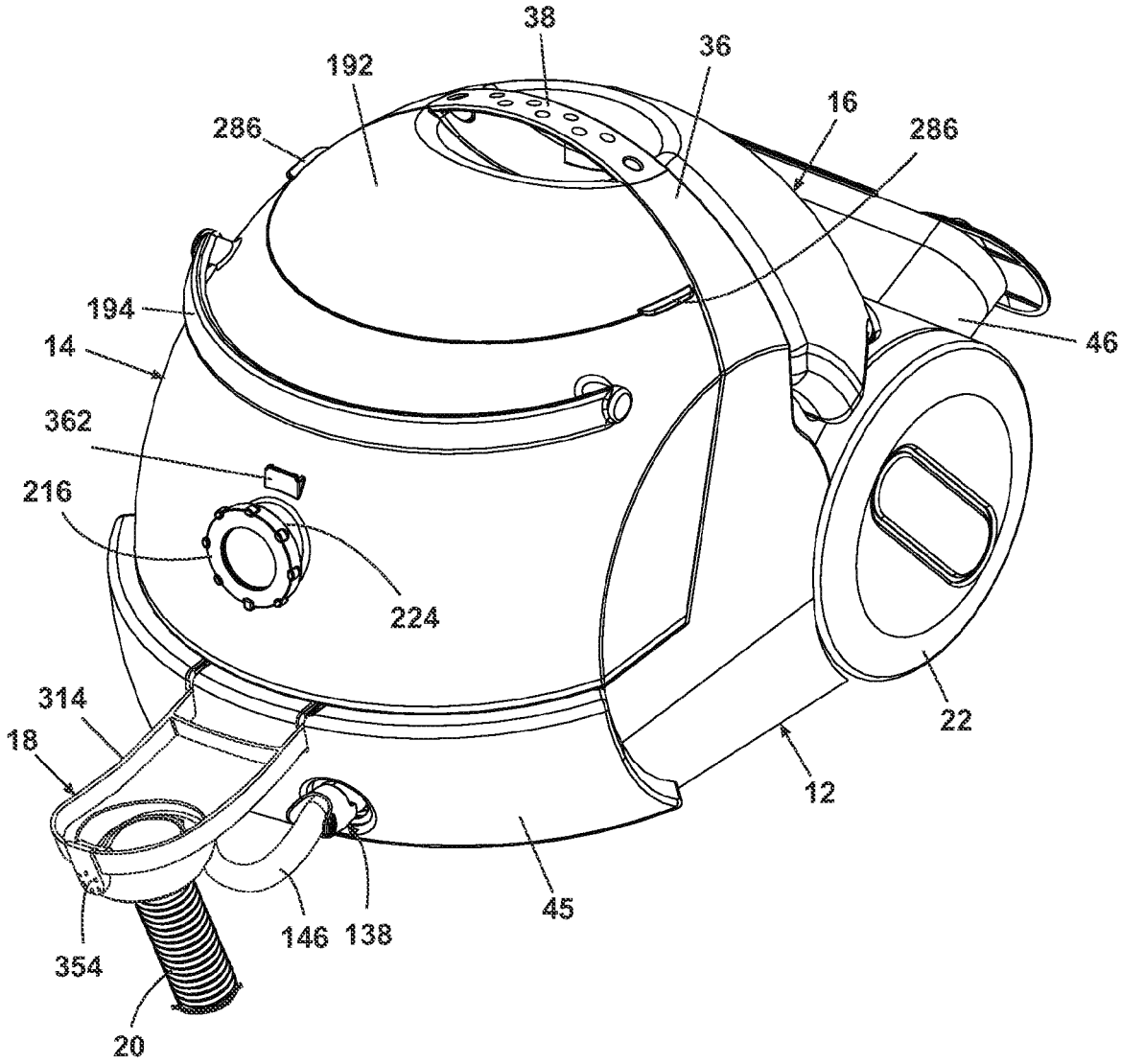
FIG. 22 is a perspective view of the vacuum cleaner, illustrating the hose interface removed from the recovery tank assembly.
Figure 23:
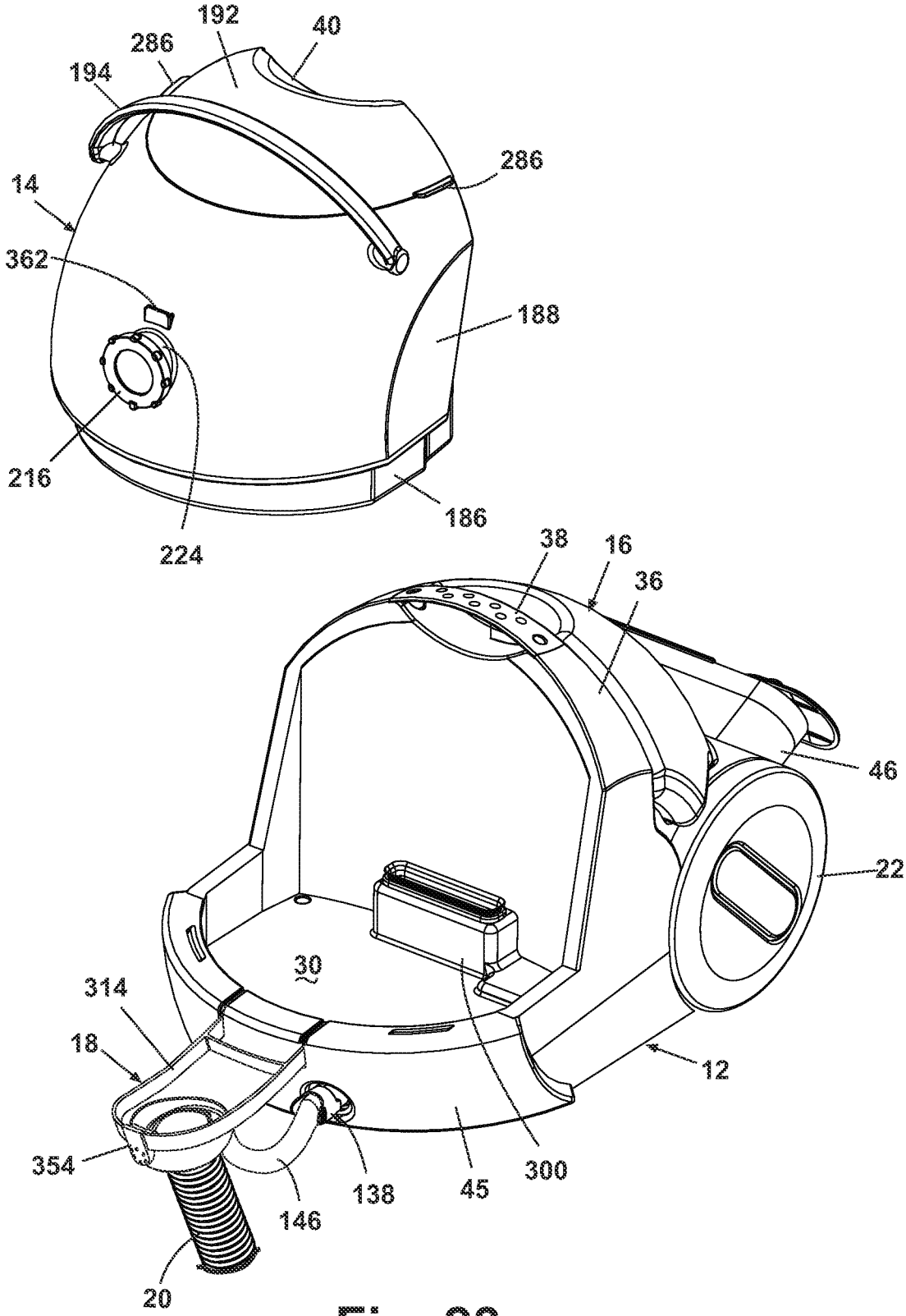
FIG. 23 is a view similar to FIG. 22, illustrating the recovery tank assembly removed from the vacuum cleaner.

Referring to FIGS. 1, 22 and 23, the hose interface 18 is moveable from a first position, shown in FIG. 1, in which the hose interface 18 is coupled with the recovery tank assembly 14, and a second position, shown in FIG. 22, in which the hose interface 18 is removed from the recovery tank assembly 14. With the hose interface 18 in the second position, the recovery tank assembly 14 can be removed from the vacuum cleaner 10, as shown in FIG. 23, without detaching the vacuum hose 20 from the hose interface 18. The hose interface 18 is maintained in the first position by the mating of the latch 354 with the catch 362. In the first position, the central opening 320, and thus the vacuum hose 20, is in fluid communication with the diverter assembly 198, and furthermore partially receives the diverter receiver conduit 224 so that the diverter gasket 216 abuts the rear surface of the hose door 314 around the central opening 320. In the second position, the central opening 320, and thus the vacuum hose 20, is not in fluid communication with the recovery tank assembly 14.

Figure 4:
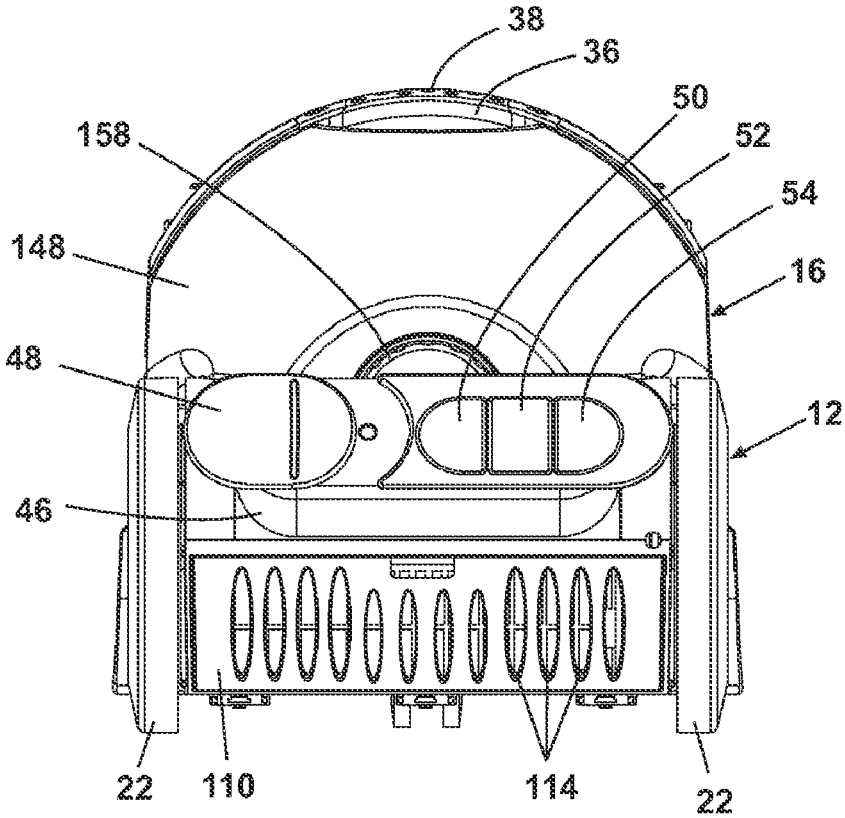
FIG. 4 is a rear view of the vacuum cleaner from FIG. 1.
Figure 24:
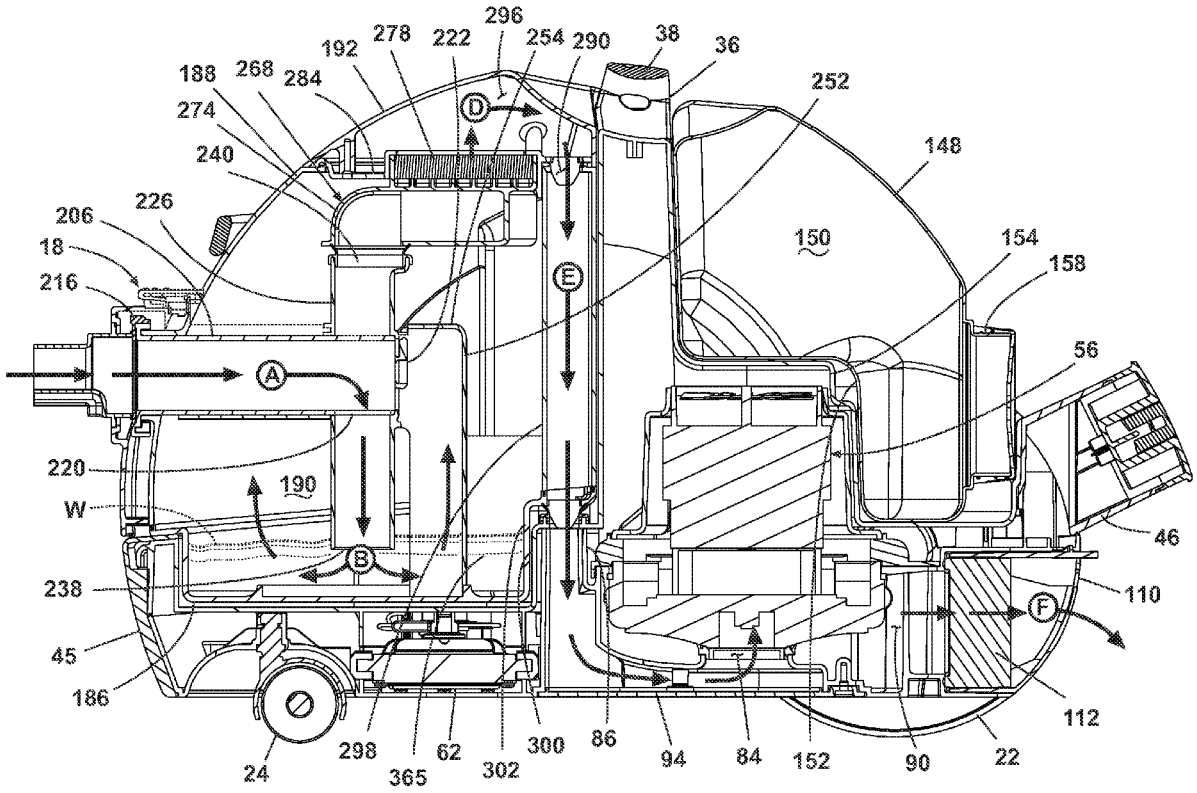
FIGS. 24 and 25 are cross-sectional views of the vacuum cleaner according to the invention similar to FIG. 15, illustrating the operation of the vacuum cleaner in the dry mode.
Figure 25:
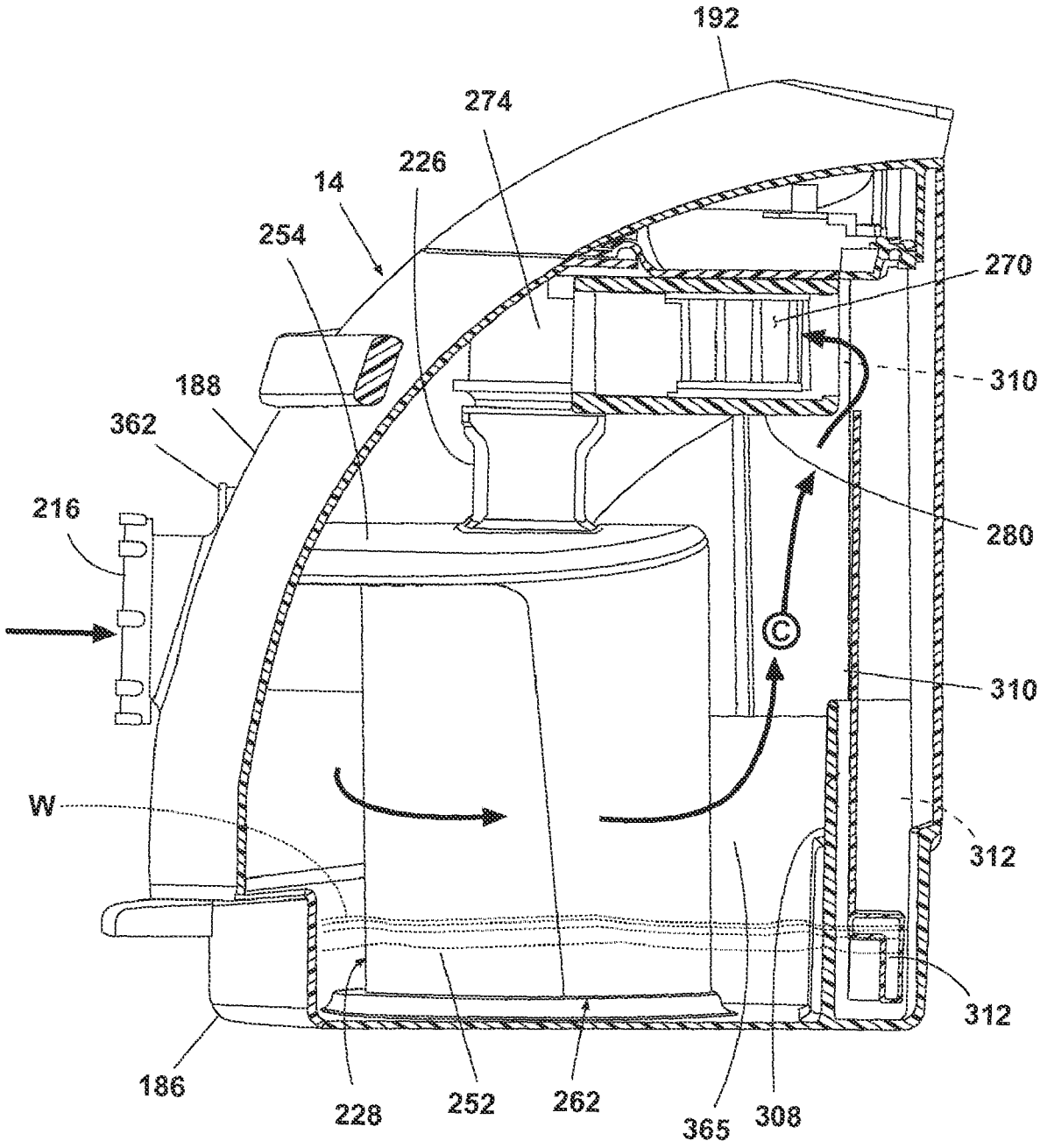

The operation of the vacuum cleaner 10 will now be described with reference to FIGS. 24-27. Referring to FIGS. 24 and 25, when the vacuum cleaner 10 is to be operated in the dry mode, the diverter gasket 216 is turned to the dry cleaning position, such that the diverter opening 220 is oriented downward in the duct 226 and is in fluid communication with the air outlet 238. The motor/fan assembly 56 is then activated using the suction source switch 52 (FIG. 4), which completes an electrical circuit from facility power, through the electrical cord. The resultant suction generated creates a working airflow through the vacuum cleaner 10, as shown by arrows A-F, which lifts dirt from the surface being cleaned through an above-the floor cleaning tool attached to the vacuum hose 20.

In the first stage of filtering, the dirt-laden air travels through the diverter tube 206 and into the duct 226 through the downwardly-oriented diverter opening 220, as indicated by the series of arrows A. The dirt-laden air then enters the water bath W in the recovery chamber 190 by passing through the air outlet 238 of the duct 226. Dirt and other debris are captured by the water bath and relatively clean air is drawn up through the water, as indicated by the series of arrows B.

In the second state of filtering, the relatively clean air is then drawn into separator assembly 202 through the air inlet conduit 270, where any remaining debris or moisture entrained in the air is captured by the foam filter 278, as indicated by the series of arrows C. Clean air exits the filter chamber 272 through the baffle plate 284 and enters the outlet openings 290, as indicated by the series of arrows D. The clean air then travels downward through the upper and lower recovery tank outlet conduits 289, 84 and into the motor/fan assembly housing through the inlet opening 84, as indicated by the series of arrows E. The air is then exhausted from the motor/fan assembly housing through the outlet opening 90 and exits the vacuum cleaner 10 through the post-motor filter assembly 58, as indicated by the series of arrows F. After cleaning is complete, the hose interface 18 can be moved to the second position (FIG. 22), and the recovery tank assembly 14 can be removed from the base assembly 12 and taken to a suitable location for disposal of the collected dirt, other debris, and the spent water bath.

Dry mode cleaning can also be performed with an empty recovery chamber 190. The working airflow path through the vacuum cleaner 10 is the same, however, the first-stage water bath filter is absent, large debris is contained within the recovery chamber 190, and the exit air is filtered by the foam filter 278 before reaching the inlet 84 to the motor/fan assembly 56. Furthermore, the tool caddy 178 can be placed on the base assembly 12 in place of the solution tank assembly 16 so that the user can easily selectively access accessory tools for specific cleaning needs.

Figure 26:
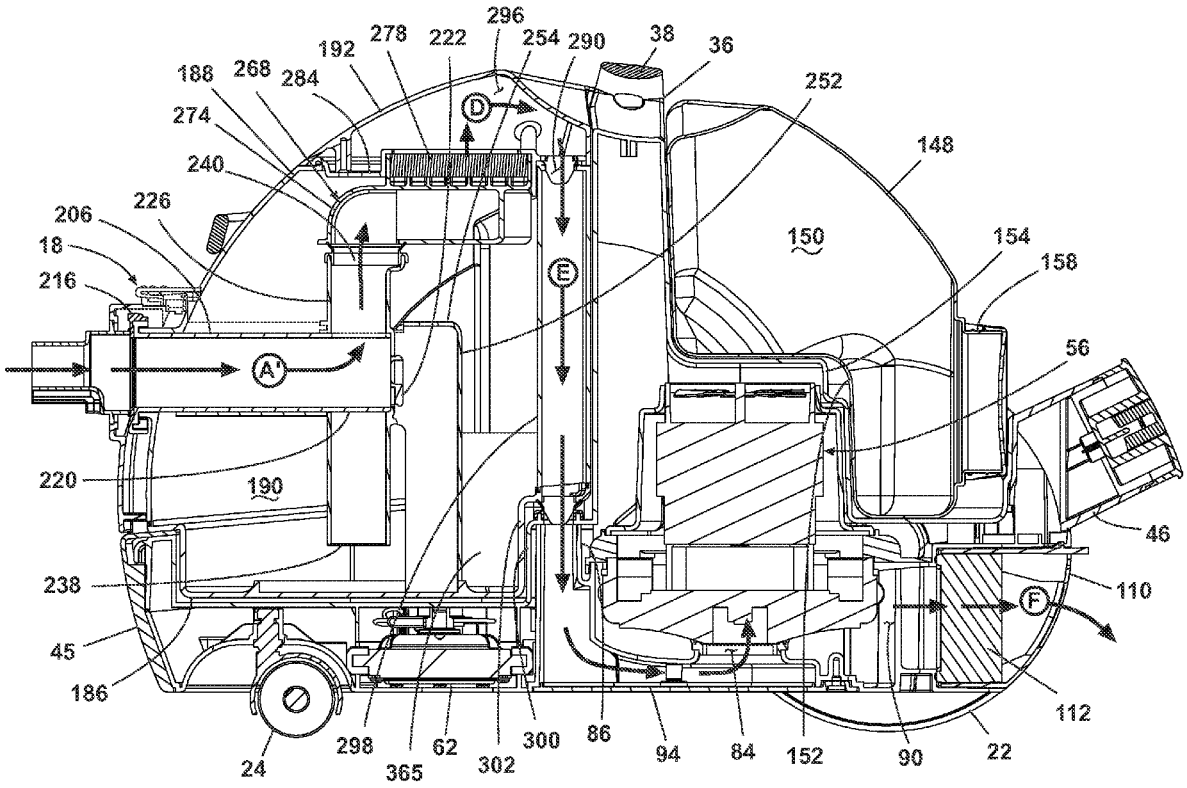
FIGS. 26 and 27 are cross-sectional views of the vacuum cleaner according to the invention similar to FIG. 15, illustrating the operation of the vacuum cleaner in the wet mode.
Figure 27:
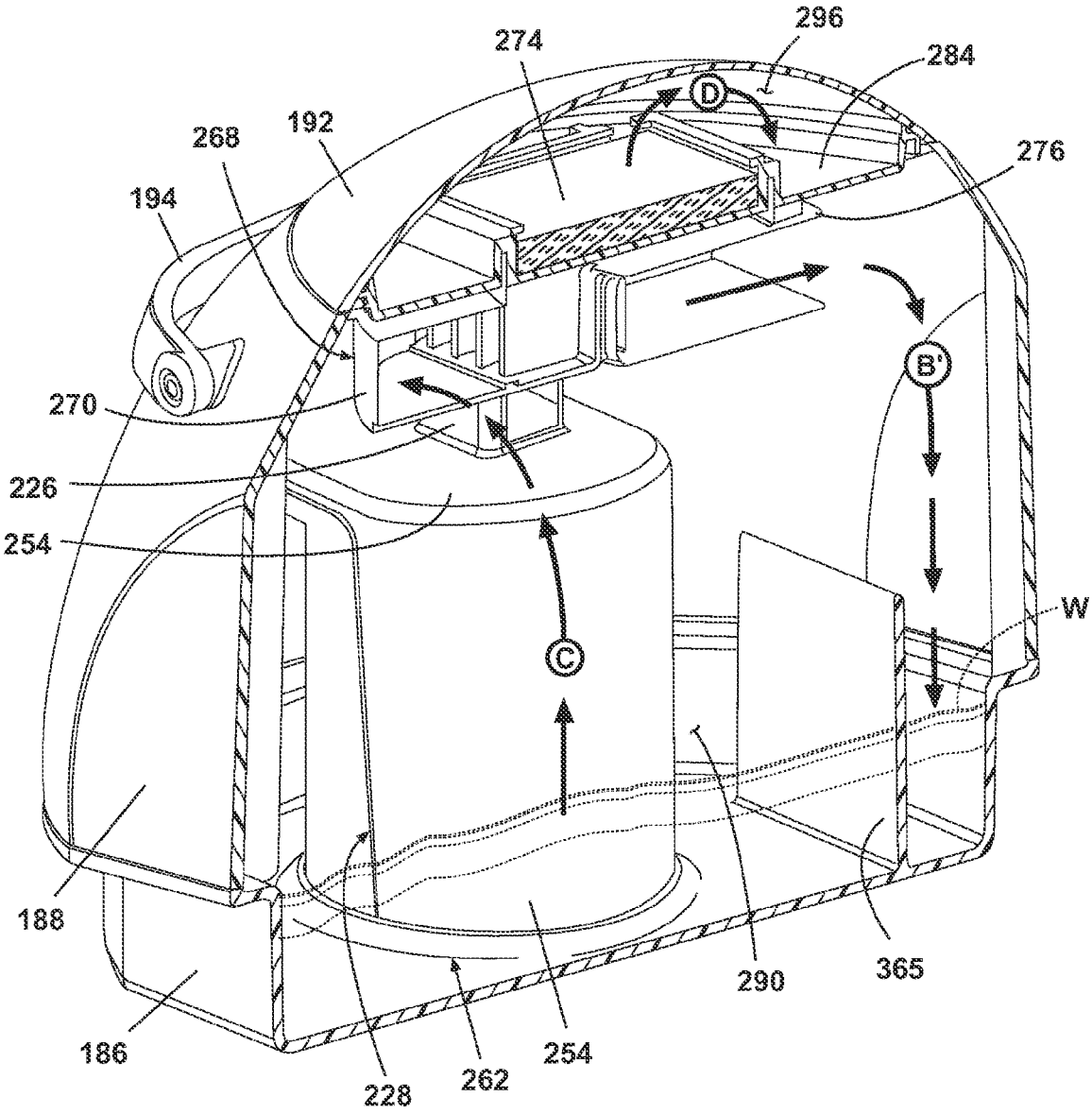

Referring to FIGS. 25-27, when the vacuum cleaner 10 is to be operated in the wet mode for picking up wet debris and liquids, the diverter gasket 216 is turned to the wet cleaning position, such that the diverter opening 220 is oriented upward in the duct 226 and is in fluid communication with the liquid outlet 240. The motor/fan assembly 56 is then activated using the suction source switch 52 (FIG. 4), which completes an electrical circuit from facility power, through the electrical cord. The resultant suction generated creates a working airflow through the vacuum cleaner 10, as shown by arrows, A', B', and C-F, which lifts dirt from the surface being cleaned through an above-the floor cleaning tool attached to the vacuum hose 20.

In the first stage of filtering, the liquid-laden air travels through the diverter tube 206 and into the duct 226 through the upwardly-oriented diverter opening 220, as indicated by the series of arrows A'. The liquid-laden air then enters the liquid inlet conduit 274 of the separator housing 268 by passing through the liquid outlet 240 of the duct 226. From the liquid inlet conduit 274, the liquid-laden air passes through the liquid guide conduit 276 and it directed out a side of the separator housing 268 and into the recovery chamber 190, as indicated by the series of arrows B'. The liquid-laden air is forced against the inner wall of the upper casing 188, which causes the liquid to separate from the air. The recovery tank assembly 14 can optionally comprise a vertical wall 365 extending upwardly from the lower casing 186 and positioned beneath the outlet of the liquid guide conduit 276. The vertical wall 354 reduces turbulence in the recovery chamber 190 and minimize foaming inside the recovery tank assembly 14. Air exhausted from the recovery chamber 190 in wet mode cleaning is the same as for dry mode cleaning and follows the same working airflow path as previously described for arrows C-F (FIGS. 24 and 25).

When solution distribution is desired during wet mode cleaning, the solution tank 148 is filled with cleaning solution and secured on the base assembly 12. The fluid pump 60 is then activated using the fluid pump switch 54 (FIG. 4), which completes an electrical circuit from facility power, through the electrical cord. The resultant pressure forces the cleaning solution through the system. The heater 62 may be activated at any time using the fluid heater switch 50 (FIG. 4) to heat or reheat the cleaning solution.

Extraction cleaning is performed in a similar manner. The carpeted floor surface is first dry vacuumed with the vacuum cleaner 10 in dry mode, as described above. The vacuum cleaner 10 is then switched to wet mode and cleaning solution is alternately distributed and recovered until the cleaning operation is complete.

The vacuum cleaner 10 can further be provided with any number of above-the-floor cleaning tools for use in conjunction with the vacuum hose 20. For example, the vacuum cleaner can be provided with separate cleaning tools for use when performing dry vacuuming, wet vacuuming, and extraction cleaning. As is common in the art, the vacuum hose 20 preferably comprises a suction conduit in fluid communication with the suction conduit of the hose interface 18 to provide a path for dirt-laden air and liquid to move from a surface to be cleaned to the recovery tank assembly 14 and a clean solution conduit in fluid communication with the solution conduit 146 attached to the coupler assembly 138 so that one vacuum hose can be used for both cleaning modes.

The above-the-floor cleaning tool is preferably connected to the vacuum hose 20 via a wand tool 366, shown in FIG. 1. The wand tool 366 comprises an elongated body 368 having a handle assembly 369 with an integral handle grip 371 and a hose attachment end 370 that is coupled with the end of the vacuum hose 20 opposite the hose interface 18. The elongated body 368 has at a free end a tool attachment end 372 that can be coupled with an above-the-floor cleaning tool. The elongated body 368 can further include a suction conduit 374 and a solution conduit 376 in respective fluid communication with the suction conduit and solution conduit of the vacuum hose 20. The wand tool 366 further comprises a trigger assembly 378 that controls the distribution of cleaning solution to the surface to be cleaned.

Figure 28:
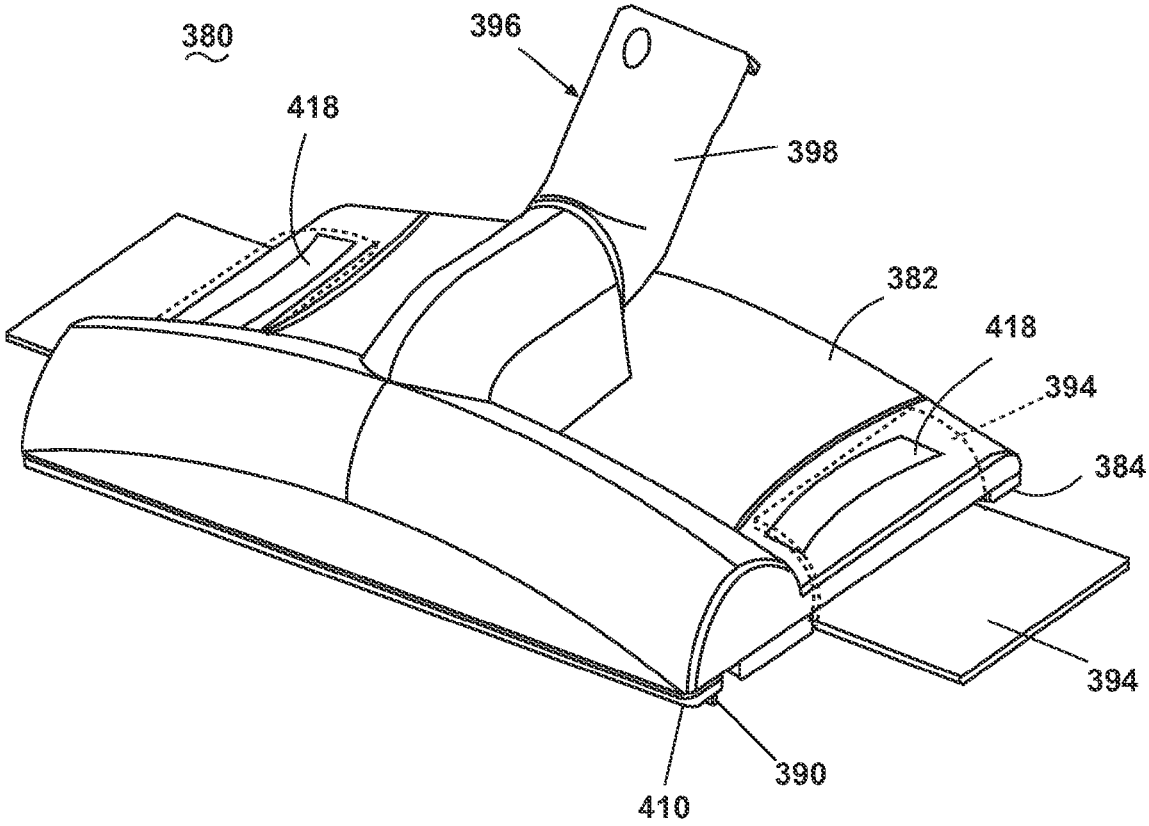
FIG. 28 is a top perspective view of a bare floor tool for use with the vacuum cleaner.
Figure 29:
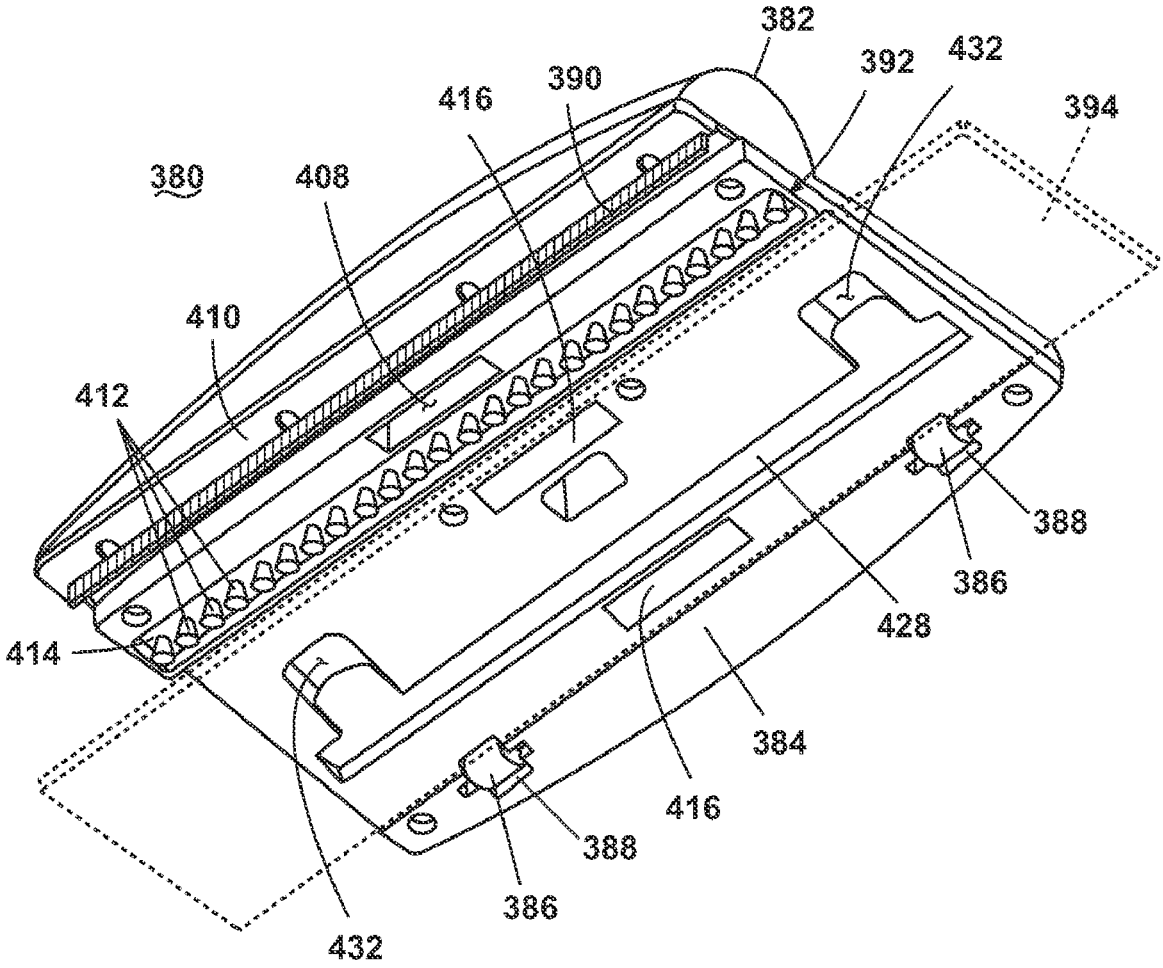
FIG. 29 is a bottom perspective view of the bare floor tool from FIG. 28.
Figure 30:
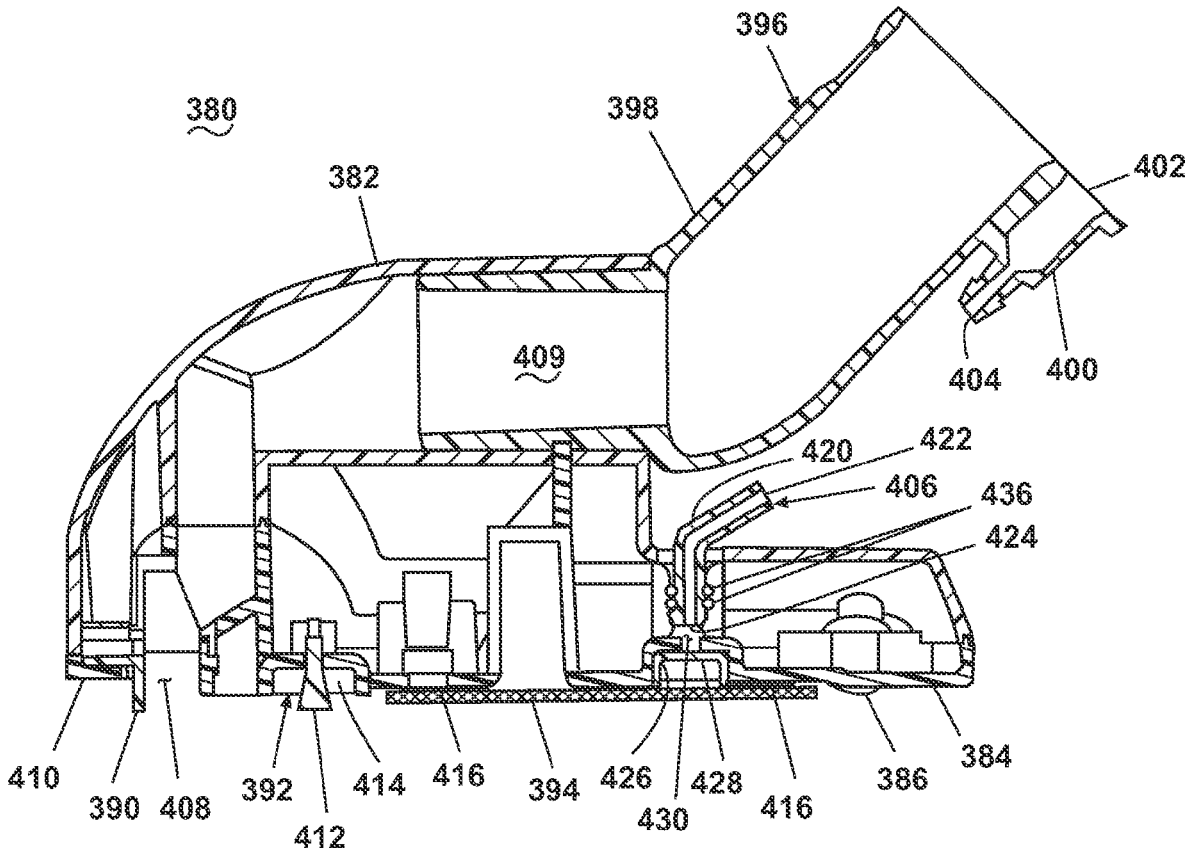
FIG. 30 is a side perspective view of the bare floor tool from FIG. 28.
Figure 31:
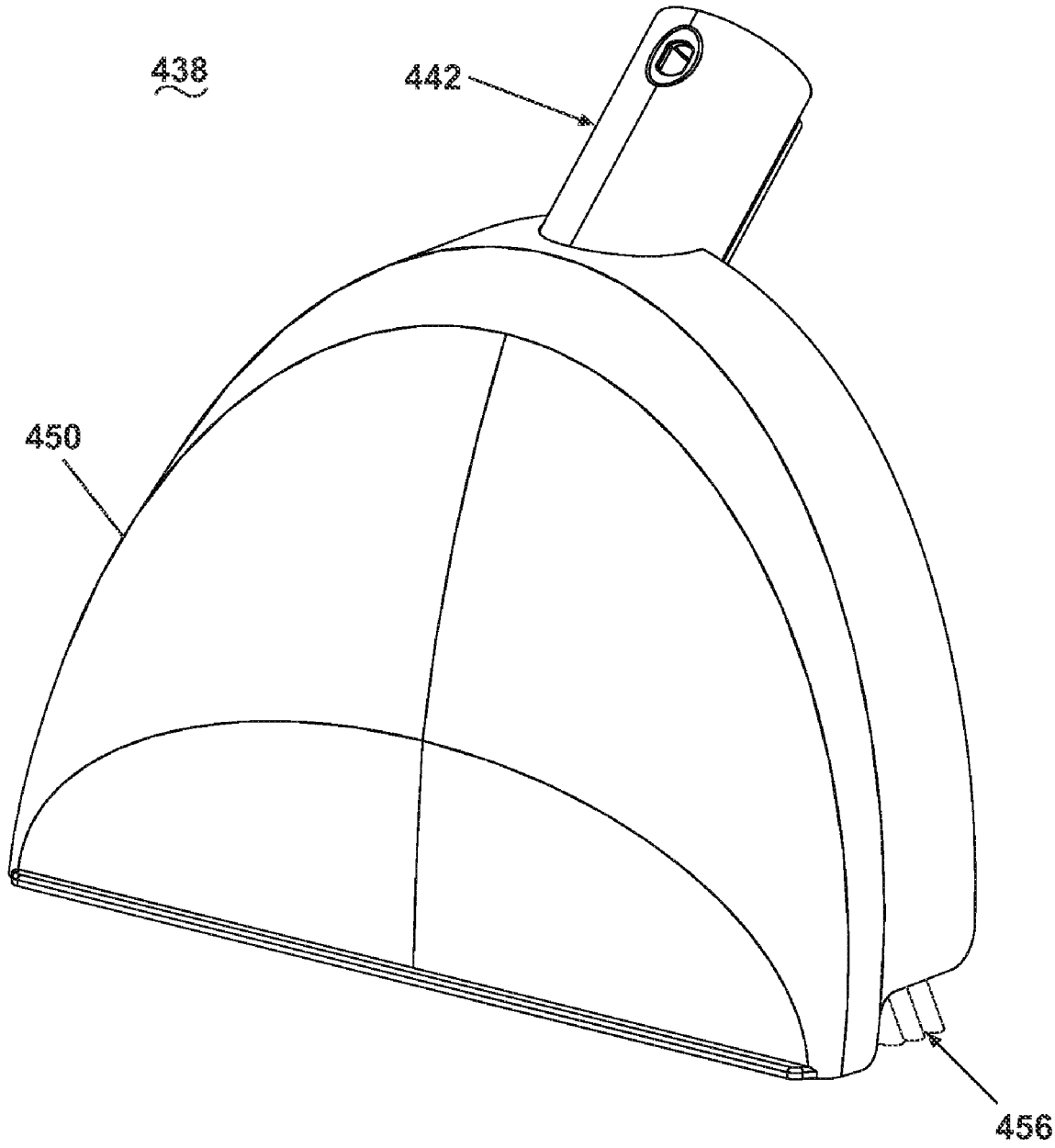
FIG. 31 is front perspective view of an above-the-floor tool for use with the vacuum cleaner shown in FIGS. 1-27.
Figure 32:
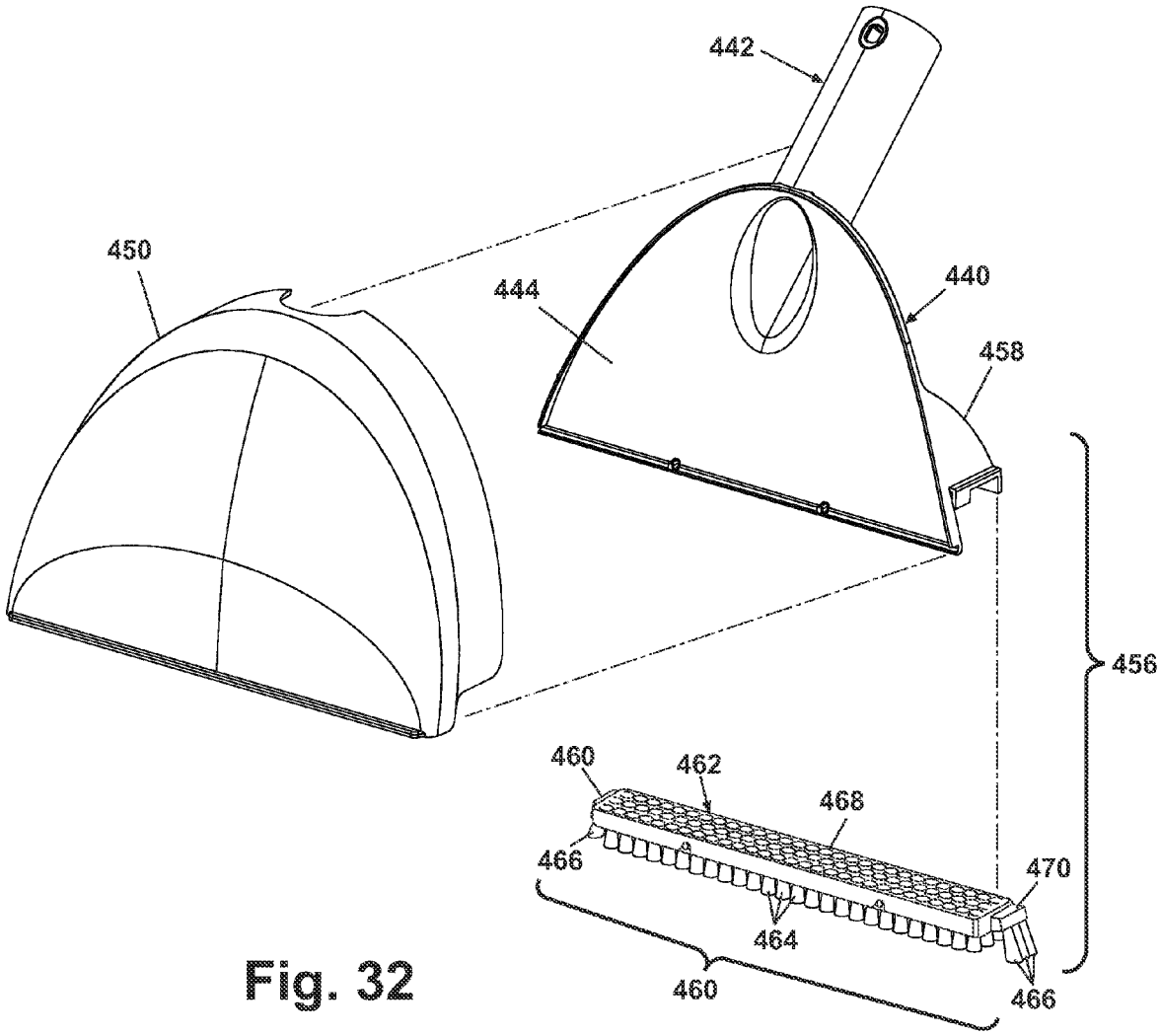
FIG. 32 is an exploded view of the above-the-floor tool illustrated in FIG. 31.
Figure 33:
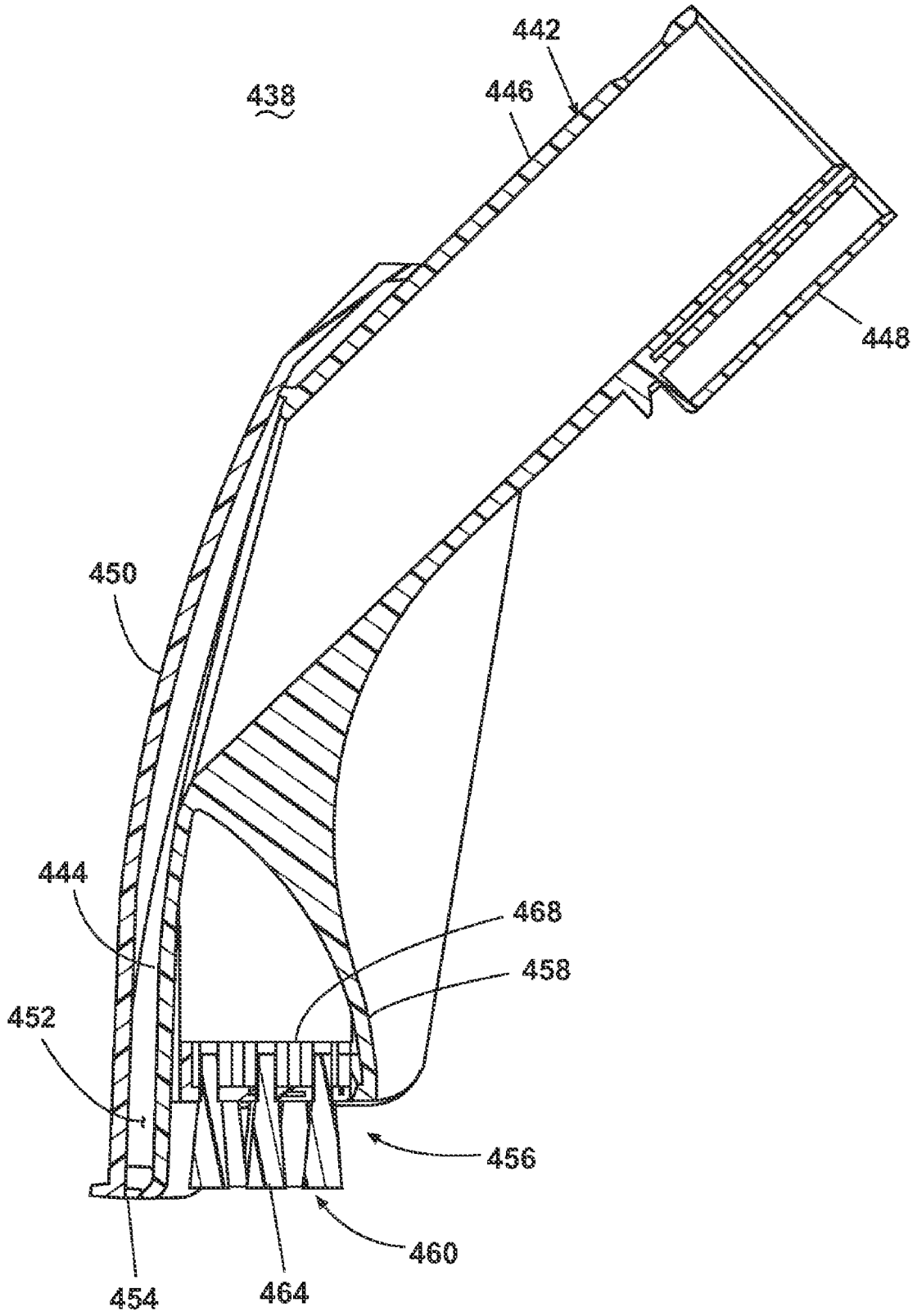
FIG. 33 is a side sectional view of the above-the-floor tool illustrated in FIGS. 31 and 32.

Referring to FIGS. 28-30, one example of an above-the-floor cleaning tool for use with the vacuum cleaner 10 is shown and comprises bare floor tool 380. The bare floor tool 380 can be used for cleaning bare surfaces during dry and wet mode cleaning and is capable of suctioning dry or liquid debris and for distributing cleaning solution. The bare floor tool 380 comprises a top enclosure 382 mounted to a frame 384 to define a cavity therebetween that houses several components of the bare floor tool 380. The frame 384 provides structural support for several of the components, such as a pair of wheels 386 rotatably mounted in corresponding wheel receivers 388 for maneuvering the bare floor tool 380 across a surface to be cleaned, a squeegee 390, a brush assembly 392, and a detachable cleaning pad 394.

The top enclosure includes a connector 396 that is configured to removably couple with the vacuum hose 20 or wand tool 366 and includes a suction conduit 398 and a solution conduit receiver 400 having an inlet end 402 in fluid communication with a source of cleaning solution, such as the solution tank assembly 16 and an outlet end 404. A solution conduit (not shown) is coupled between the outlet end 404 and a solution distributor 406 mounted within the frame 384.

The bare floor tool 380 further comprises a suction nozzle opening 408 formed on the underside of the frame 384 which, in operation, is configured to be positioned adjacent the surface to be cleaned. The suction nozzle opening 408 is in fluid communication with the suction conduit 398 of the connector via a fluid flow path 409 formed by the top enclosure 382 and frame 384.

The squeegee 390 is mounted in front of the suction nozzle opening 408 by a squeegee plate 410 attached to the front portion of the frame 384. As illustrated, the squeegee 390 can contain nubs or ribs on a forward surface that facilitates liquid and debris passage under the squeegee 390 when moving in a forward direction. The opposite side, or back side, of the squeegee 390 is a smooth surface that effectively moves surface moisture towards the suction nozzle. The brush assembly 392 is positioned rearwardly of the suction nozzle opening 408 and includes a plurality of bristle tufts 412 secured in a bristle holder 412 integrally formed in the frame 384.

The cleaning pad 394 is secured to the bare floor tool 380 by a cleaning pad retainer, which is illustrated as a pair of lower pad attachment devices 416 located on the underside of the frame 384 and pair of upper pad attachment devices 418 located on the upper surface of the top enclosure 382. The attachment devices 416, 418 are preferably made of the hook portion of a commonly known hook and loop fastener material, such as Velcro®, and are secured to the frame 384 and top enclosure 382 with adhesive or other commonly known attachment mechanism.

The solution distributor 406 comprises a hollow distributor nozzle 420 having an inlet end in communication with the solution conduit receiver 400 and an outlet end in communication with a distributor recess 426 integrally formed in the underside of the frame 384 and closed by a insert 428 to form an elongated solution channel 430 having an outlet channel 432 near either end therebetween through which solution is distributed. The outlet channels 432 are preferably positioned to dispense cleaning solution onto the cleaning pad 394, although the solution distributor 406 can alternately be configured to dispense cleaning solution onto the brush assembly 392 or directly onto the surface to be cleaned. Seals, such as O-rings 436 can be placed between the distributor nozzle 420 and the frame 384.

Referring to FIGS. 31-34, another example of an above-the-floor cleaning tool for use with the vacuum cleaner 10 is shown and comprises an extraction cleaning tool 438. The extraction cleaning tool 438 can be used for deep cleaning fabric covered surfaces, such as carpets, and is capable of distributing cleaning solution onto a surface to be cleaned and of recovering spent cleaning solution and debris from the surface to be cleaned. The extraction cleaning tool 438 comprises a tool body 440 having a connector portion 442 at one end thereof and a rear suction nozzle portion 444 at another end thereof. The connector portion 442 is configured for coupling with the vacuum hose 20 or the wand tool 366 and comprises a suction conduit 446 joined with a solution distributor receiver 448 for receiving a solution distributor (not shown) in fluid communication with a source of cleaning solution, such as the solution tank assembly 16 and dispenses cleaning solution upon actuation of an actuator, such as the trigger assembly 378 on the wand tool 366. A front suction nozzle portion 450 is joined with the rear suction nozzle portion 444 to form a fluid flow path 452 therebetween. The fluid flow path 452 extends between a suction nozzle opening 454, which, in operation, in positioned adjacent the surface to be cleaned, and the suction conduit 446 of the connector portion.

Figure 34:
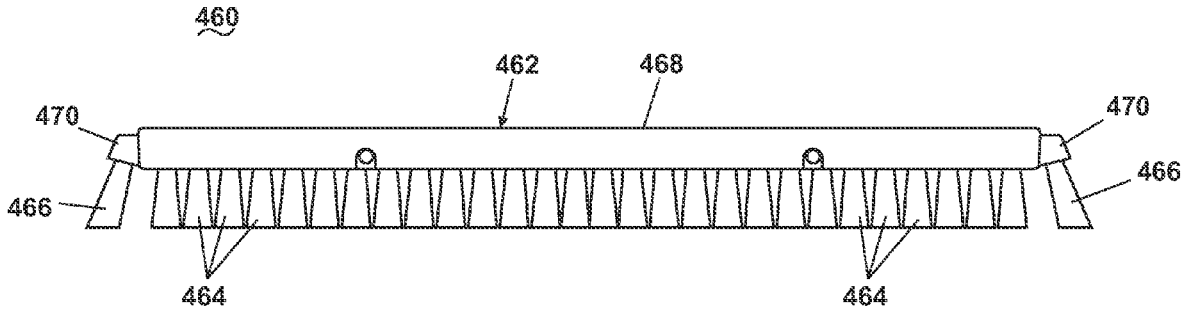
FIG. 34 is a front view of the brush that forms a part of the above-the-floor tool illustrated in FIGS. 31-33.

The extraction cleaning tool 438 further comprises an agitator assembly 456 for agitating the surface to be cleaned. Preferably, cleaning solution is dispensed in the region on the agitator assembly 456 by the solution dispenser so that is can be worked into the surface to be cleaned before it is ingested through the suction nozzle opening 454. The agitator assembly 456 comprises an agitator housing 458 integrally formed with the tool body 440 behind the rear suction nozzle portion 444 and an agitator 460 mounted within the agitator housing 458. As illustrated, the agitator 460 comprises an elongated support 462 and a plurality of bristle tufts 464, 466 depending from the support 464. Referring to FIG. 34, the support 462 includes a primary support potion 468, which comprises shorter, straighter bristle tufts 464 and two secondary support portions 470 formed at either end of the primary support portion 468, which comprises longer, more angled bristle tufts 466 to effectively clean in corners as is found along wall baseboards or at the base of individual steps on a stair case.

Figure 35:
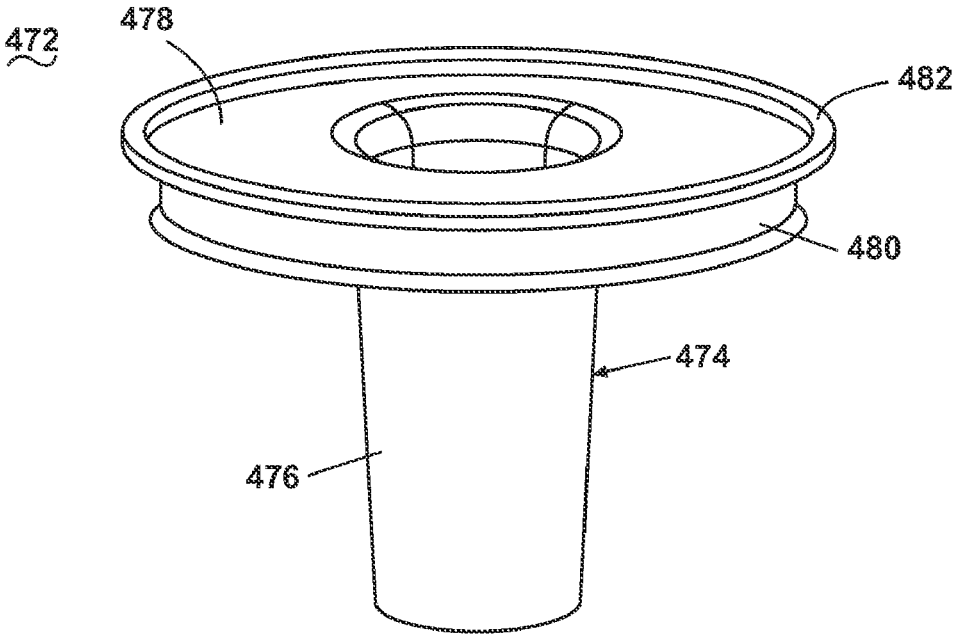
FIG. 35 is a perspective view of an above-the-floor drain cleanout tool for use with the vacuum cleaner shown in FIGS. 1-27.
Figure 36:
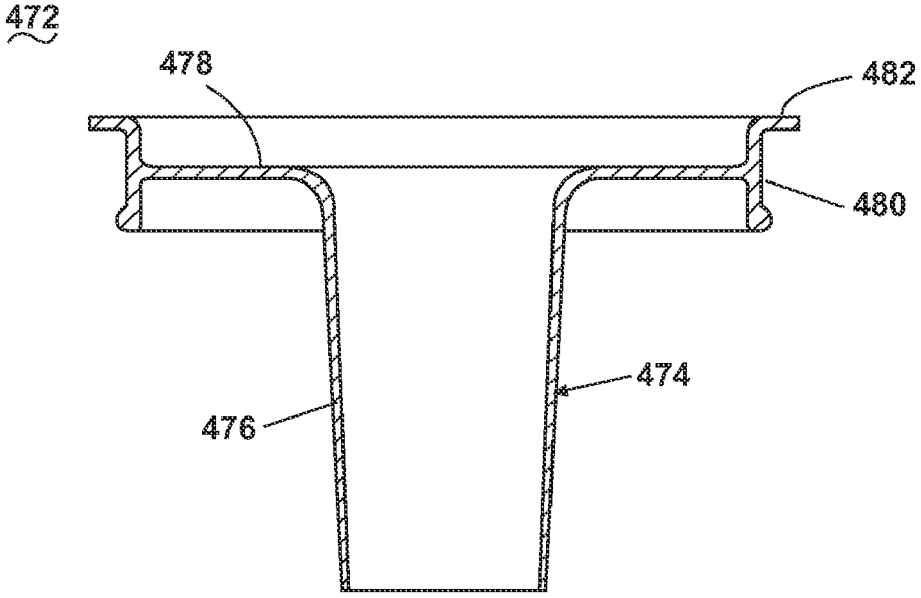
FIG. 36 is a sectional view of the above-the-floor drain cleanout tool illustrated in FIG. 35.

Referring to FIG. 35 and 36, yet another example of an above-the-floor cleaning tool for use with the vacuum cleaner 10 is shown and comprises a drain cleanout tool 472 that can be used in the wet cleaning mode for removing blockages in sinks, showers, and the like. The drain cleanout tool 472 comprises a one-piece body 474 having a connector conduit 476 for connection with the vacuum hose 20 or wand tool 266 and a vacuum cap 478 integrally formed with the connector conduit 476. The vacuum cap 478 comprises a circumferential flange 480 having a lip 482 formed at one end for sealing against a surface having a drain opening, in a manner similar to a suction cup. Preferably, at least the vacuum cap 478 of the drain cleanout tool 472 is formed from a rubber or other similar material that is sufficiently flexible to form a vacuum seal.

In use, the drain cleanout tool 472 is coupled with the vacuum cleaner 10, and the vacuum cap 478 is positioned over a drain opening having a blockage or clog to form a seal between the lip 482 and the surface having the drain opening. Once a seal is formed, the vacuum cleaner 10 is turned "on" and the suction generated will pull the blockage out of the drain opening, through the connector conduit 476 and into the recovery tank assembly 14 via the vacuum hose 20.

While the invention has been specifically described in connection with certain specific embodiments thereof, it is to be understood that this is by way of illustration and not of limitation, and the scope of the appended claims should be construed as broadly as the prior art will permit.

What is claimed is:

1. A combination wet-dry vacuum cleaner comprising:

a recovery tank having:

a single recovery chamber;

an air-liquid separator within the recovery chamber for separating air from liquid within the recovery chamber;

a first conduit in communication with the recovery chamber; and a second conduit in communication with the air-liquid separator; and a diverter tube mounted to the recovery tank for rotation relative to the recovery tank and having an inlet opening at a first end thereof adapted for fluid communication with a vacuum hose and an outlet opening spaced from the first end;

wherein the diverter tube is rotatable within the recovery tank for movement between a dry mode position, in which outlet opening is in communication with the first conduit to direct dry dirt-laden air to the recovery chamber, and a wet mode position, in which the outlet opening is in communication with second conduit to direct liquid-laden air to the air-liquid separator.

2. The vacuum cleaner of claim 1, wherein the first and second conduits are integral and the outlet opening is positioned within the integral conduit to define the first conduit as extending downwardly with respect to the outlet opening and the second conduit as extending upwardly with respect to the outlet opening.

3. The vacuum cleaner of claim 1, and further comprising an actuator provided on the recovery tank for moving the diverter tube between the dry mode position and the wet mode position.

4. The vacuum cleaner of claim 3, wherein the actuator comprises a gasket that forms a seal between the recovery tank and a vacuum hose.

5. The vacuum cleaner of claim 2 and further comprising a detent mechanism for releasably retaining the diverter tube in at least one of the dry mode position and wet mode position.

6. The vacuum cleaner of claim 5, wherein the detent mechanism is positioned between the diverter tube and the integral conduit.

7. The vacuum cleaner of claim 1 and further comprising a detent mechanism for releasably retaining the diverter tube in at least one of the dry mode position and the wet mode position.

8. The vacuum cleaner of claim 1 wherein diverter tube is mounted for rotation about a longitudinal axis of the diverter tube in the recovery tank.

9. The vacuum cleaner of claim 1 and further comprising a wheeled base, wherein the recovery tank is removably mounted on the base.

10. The vacuum cleaner of claim 9 and further comprising a hose interface adapted to mount a vacuum hose and pivotally mounted on the base for selective fluid communication with the diverter tube, wherein the hose interface is moveable between a first position, in which the hose interface is coupled with the diverter tube, and a second position in which the hose interface is spaced from the diverter tube.

11. The vacuum cleaner of claim 10, wherein the hose interface comprises a latch and the recovery tank comprises a latch receiver that is adapted to receive the latch when the hose interface is in the first position to thereby secure the hose interface in the first position.

12. The vacuum cleaner of claim 11, wherein the latch comprises a catch and the latch receiver comprises a lip that is adapted to receive the catch when the hose interface is in the first position to thereby secure the hose interface in the first position.

13. The vacuum cleaner of claim 12, wherein the latch is movable between a lip retraining position against the lip and a lip release position away from the lip and is biased to the lip retaining position to secure the hose interface in the first position when the hose interface is in the first position.

14. The vacuum cleaner of claim 13, wherein the hose interface further comprises a door, and the latch is moveably mounted to the door.

15. The vacuum cleaner of claim 10, wherein the hose interface comprises a hose adapter and a door, and the hose adapter is removably mounted to the door.

16. The vacuum cleaner of claim 15, wherein the hose adapter comprises a conduit forming a through opening for fluid connection with the vacuum hose.

17. The vacuum cleaner of claim 16, wherein the conduit comprises a recess that is adapted to receive a solution conduit.

18. The vacuum cleaner of claim 10 and further comprising a gasket positioned at one end of the inlet conduit and adapted to seal the recovery tank to the hose interface.

* * * * *